US011421367B2

(12) United States Patent
Kim

(10) Patent No.: US 11,421,367 B2
(45) Date of Patent: Aug. 23, 2022

(54) LAUNDRY PROCESSING APPARATUS

(71) Applicant: Samsung Electronics Co., Ltd., Suwon-si (KR)

(72) Inventor: Mikyoung Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/087,344

(22) Filed: Nov. 2, 2020

(65) Prior Publication Data

US 2021/0207309 A1 Jul. 8, 2021

(30) Foreign Application Priority Data

Jan. 3, 2020 (KR) ..... 10-2020-0000888
Jun. 3, 2020 (KR) ..... 10-2020-0067048

(51) Int. Cl.

| | |
|---|---|
| ***D06F 34/28*** | (2020.01) |
| ***D06F 34/05*** | (2020.01) |
| ***D06F 29/00*** | (2006.01) |
| ***D06F 103/40*** | (2020.01) |
| ***D06F 101/14*** | (2020.01) |

(52) U.S. Cl.

CPC ..... *D06F 34/28* (2020.02); *D06F 29/005* (2013.01); *D06F 34/05* (2020.02); *D06F 2101/14* (2020.02); *D06F 2103/40* (2020.02)

(58) Field of Classification Search

CPC ..... D06F 29/005; D06F 34/28; D06F 34/34; D06F 34/32

See application file for complete search history.

(56) References Cited

U.S. PATENT DOCUMENTS

| | | | | |
|---|---|---|---|---|
| 9,951,451 | B2 | 4/2018 | Park et al. | |
| 10,745,841 | B2 | 8/2020 | Yoon et al. | |
| 2011/0241501 | A1* | 10/2011 | Heo | D06F 29/005 312/107 |

(Continued)

FOREIGN PATENT DOCUMENTS

| | | | |
|---|---|---|---|
| CN | 101168901 | A | 4/2008 |
| EP | 3348704 | A1 | 7/2018 |

(Continued)

OTHER PUBLICATIONS

Office Action dated Jul. 19, 2020 in connection with Korean Patent Application No. 10-2020-0067048, 16 pages.

(Continued)

*Primary Examiner* — Spencer E. Bell

(57) ABSTRACT

An apparatus comprising: a washing machine, a drying machine disposed on the washing machine, and a control panel. The control panel including a first user interface configured to control the washing machine, a second user interface configured to control the drying machine, a first start/pause button configured to receive an input for starting or pausing an operating of the washing machine, a second user interface configured to receive an input for controlling the drying machine, and a display configured to display operation information of the washing machine and operation information of the drying machine. The apparatus configured to control an operation of the drying machine in response to an input received through the second start/pause button while operation information of the washing machine is displayed on the display.

13 Claims, 27 Drawing Sheets

(56) References Cited

U.S. PATENT DOCUMENTS

| | | | | |
|---|---|---|---|---|
| 2018/0057987 | A1 | 3/2018 | Li et al. | |
| 2018/0202091 | A1 | 7/2018 | Son et al. | |
| 2018/0237976 | A1* | 8/2018 | Li | D06F 58/30 |
| 2019/0017212 | A1* | 1/2019 | Bergamo | D06F 34/28 |
| 2020/0024784 | A1* | 1/2020 | Yoon | D06F 58/30 |
| 2020/0141038 | A1* | 5/2020 | Xu | D06F 34/28 |

FOREIGN PATENT DOCUMENTS

| | | | | |
|---|---|---|---|---|
| EP | 3686338 | A1 * | 7/2020 | D06F 33/46 |
| KR | 20-1997-0051867 | U | 9/1997 | |
| KR | 10-0607273 | B1 | 7/2006 | |
| KR | 10-0607279 | B1 | 7/2006 | |
| KR | 10-0607280 | B1 | 7/2006 | |
| KR | 10-0717458 | B1 | 5/2007 | |
| KR | 10-2014-0032262 | A | 3/2014 | |
| KR | 10-2018-0086168 | A | 7/2018 | |
| WO | WO-2019052410 | A1 * | 3/2019 | D06F 58/48 |

OTHER PUBLICATIONS

International Search Report of the International Searching Authority in connection with International Application No. PCT/KR2020/015767 dated Mar. 4, 2021, 6 pages.

Supplementary European Search Report dated Jan. 18, 2022, in connection with European Application No. 20897621.7, 8 pages.

Korean Intellectual Property Office, "Notice of Preliminary Rejection", dated Jun. 18, 2022, in connection with Korean Patent Application No. 10-2021-0020397, 3 pages.

* cited by examiner

LAUNDRY PROCESSING APPARATUS

CROSS-REFERENCE TO RELATED APPLICATIONS

This application is based on and claims priority under 35 U.S.C. § 119 to Korean Patent Application No. 10-2020-0000888 filed on Jan. 3, 2020 and Korean Patent Application No. 10-2020-0067048 filed on Jun. 3, 2020 in the Korean Intellectual Property Office, the disclosures of which are herein incorporated by reference in their entirety.

BACKGROUND

1. Field

The disclosures relate to a washing machine, and more particularly, to a washing machine capable of communicating with a drying machine.

2. Description of Related Art

In general, a washing machine is an apparatus configured to wash laundry inside of a tub by rotating a drum rotatably installed in the tub to accommodate the laundry. The washing machine may perform a washing process using water to separate pollutants from the laundry, a rinsing process rinsing the laundry, and a dehydrating process removing water from the wet laundry.

In addition, a drying machine may include a drum that is rotatably installed, and may dry an object to be dried (laundry) by injecting high-temperature dry hot air into the drum while the drum is rotating. The drying machine may perform a drying process for drying the object to be dried.

Recently, the drying machine having a heat pump and operating only with electricity has been commercialized. As a result, restrictions on installing the drying machine have been reduced, and the number of households equipped with the washing machine with the drying machine is increasing.

For example, the drying machine may be placed side by side (horizontally) with the washing machine, or may be placed at the same position of the washing machine.

When the drying machine is placed side by side with the washing machine, a user may immediately put the washed laundry into the drying machine. However, because the drying machine is arranged side by side with the washing machine, a space occupied by the drying machine and the washing machine increases.

When the drying machine is placed on top of the washing machine, the user may immediately put the laundry into the drying machine, and the space occupied by the drying machine may be reduced similarly to using only the washing machine.

However, when the drying machine is placed on top of the washing machine, a control panel of the drying machine is located at a high position, thus the user has inconvenience in operating the drying machine.

SUMMARY

An aspect of the disclosure is to provide a washing machine capable of controlling a drying machine using a control panel of the washing machine, and a method of controlling the washing machine.

An aspect of the disclosure is to provide a washing machine capable of integrating a menu (or button) capable of controlling the washing machine and a menu (or button) capable of controlling the drying machine, and a method of controlling the washing machine.

An aspect of the disclosure is to provide a washing machine in which a menu (or button) for starting an operation of the washing machine or pausing the operation is provided separately from a menu (or button) for starting an operation of the drying machine or pausing the operation, and a method of controlling the washing machine.

Additional aspects of the disclosure will be set forth in part in the description which follows and, in part, will be obvious from the description, or may be learned by practice of the disclosure.

In accordance with an aspect of the disclosure, a washing machine includes a control panel; a drum; a drum motor; a communication device configured to exchange data with a drying machine; and a controller electrically connected to the control panel, the drum motor, and the communication device. The controller may operate in one of a first mode and a second mode depending on a first user input through the control panel, control the communication device to transmit a control command for controlling the drying machine to the drying machine in response to a second user input through the control panel in the first mode, and control the drum motor to rotate the drum in response to a third user input through the control panel in the second mode.

In response to at least one of a user input for power-on of the washing machine and a user input for controlling the drying machine, the controller may control the communication device to identify when it is communicable with the drying machine and to receive information from the drying machine. The controller may control the communication device to identify whether it is possible to communicate with the drying machine and receive information from the drying machine at predetermined times.

The control panel may include a first control switch and a second control switch. The controller may switch to the first mode in response to the user input through the first control switch in the second mode, and may switch to the second mode in response to the user input through the second control switch in the first mode.

The control panel may include at least one input switch. The controller may obtain the second user input for controlling the drying machine through the at the least one input switch in the first mode, and may obtain the third user input for controlling the drying machine through the at the least one input switch in the second mode.

The control panel includes a first action switch and a second action switch. In both the first mode and the second mode, the controller may control the communication device to transmit the control command for starting a drying operation to the drying machine in response to the user input through the first action switch, and may control the drum motor to rotate the drum for washing in response to the user input through the second action switch.

The communication device may exchange data with the drying machine, either by wire or wirelessly. When the communication device exchanges data with the drying machine by wire, the controller may control the communication device to transmit the control command for starting the drying operation of the drying machine. When the communication device exchanges data with the drying machine wirelessly, the controller may not transmit the control command for starting the drying operation of the drying machine.

The control panel may include at least one input switch. In both the first mode and the second mode, the controller may control the communication device to transmit the control command for activating remote control of the drying machine in response to the user input through the at least one input switch, and may activate remote control of the washing machine. The washing machine may further include a cabinet that accommodates the drum and has an opening formed on a front surface and a door that can close the opening. The controller may determine whether the door is closed in response to the user input through the at least one input switch, activate the remote control of the washing machine in response to determining that the door is closed, and deactivate the remote control of the washing machine in response to determining that the door is not closed.

In accordance with another aspect of the disclosure, in a method of controlling a washing machine, the washing machine includes a control panel, a drum, and a drum motor. The method includes operating in one of a first mode and a second mode, depending on a first user input through the control panel; in the first mode, transmitting a control command for controlling a drying machine in communication with the washing machine to the drying machine in response to a second user input through the control panel; in the second mode, controlling the drum motor to rotate the drum in response to a third user input through the control panel.

The control panel for operating in any one of the first mode and the second mode and obtaining a user input for the washing machine capable of communicating with the drying machine may include a first control switch configured to obtain a user input for switching to the first mode; a second control switch configured to obtain a user input for switching to the second mode; a setting switch configured to obtain a user input for selecting a drying setting in the first mode and a user input for selecting a washing setting in the second mode; a first operation switch configured to obtain a user input for starting an operation of the drying machine in both the first mode and the second mode; and a second operation switch configured to obtain a user input for starting an operation of the washing machine in both the first mode and the second mode. The setting switch may be configured to display a first image representing the drying setting in the first mode, and display a second image representing the washing setting in the second mode.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
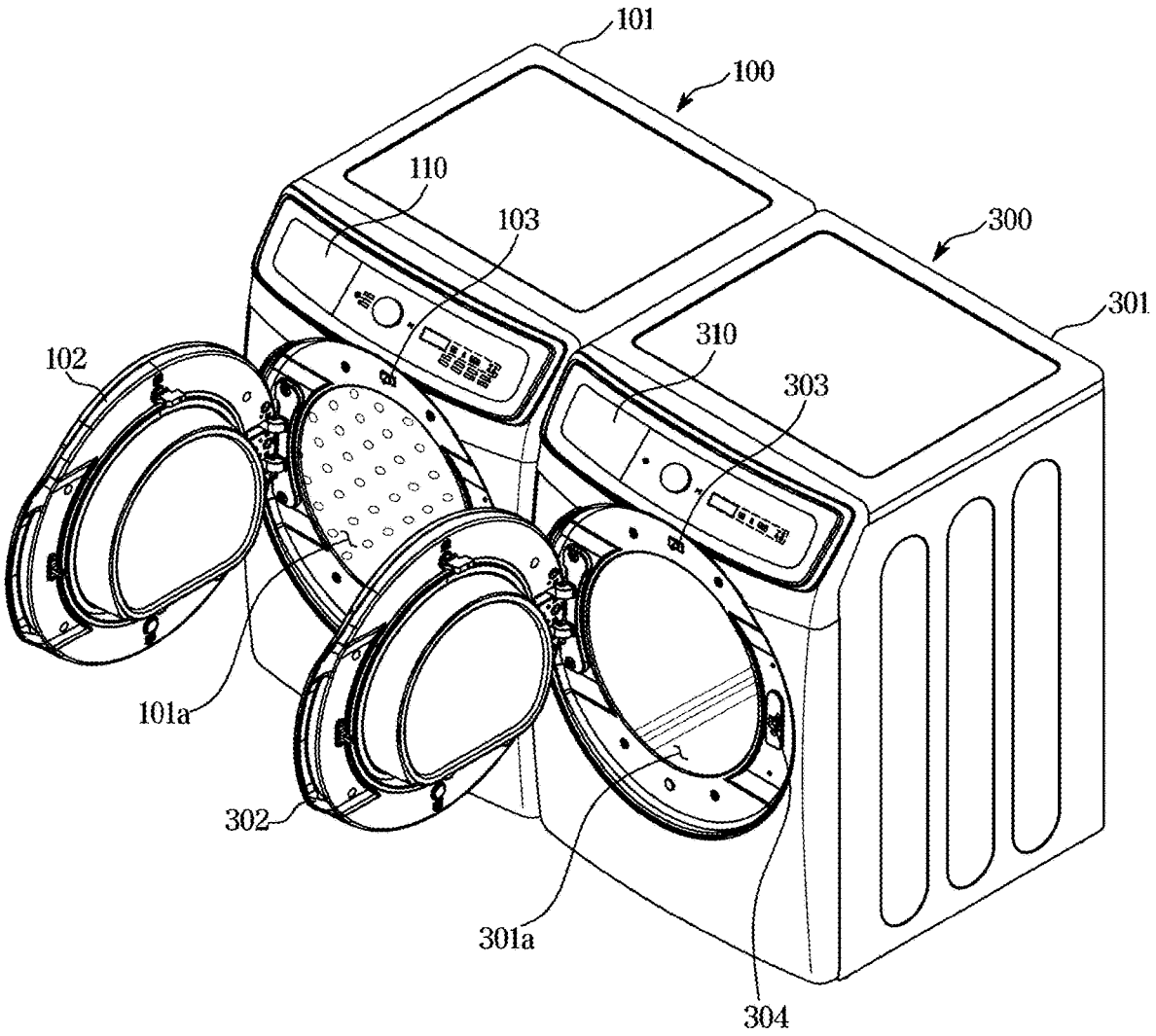
FIG. 1 is a view illustrating that a washing machine is arranged horizontally with a drying machine according to an embodiment.

FIGS. 1 through 25, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, exemplary embodiments will now be described more fully hereinafter with reference to the accompanying drawings. The exemplary embodiments may, however, be embodied in many different forms and should not be construed as being limited to the embodiments set forth herein. These embodiments are provided so that this disclosure will be thorough and complete and will fully convey the exemplary embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the exemplary embodiments of the present disclosure, examples of which are illustrated in the accompanying drawings, wherein like reference numerals refer to like elements throughout.

The expression, "at least one of a, b, and c," should be understood as including only a, only b, only c, both a and b, both a and c, both b and c, or all of a, b, and c.

Hereinafter, the operation principles and embodiments of the disclosure will be described with reference to the accompanying drawings.

Figure 2:
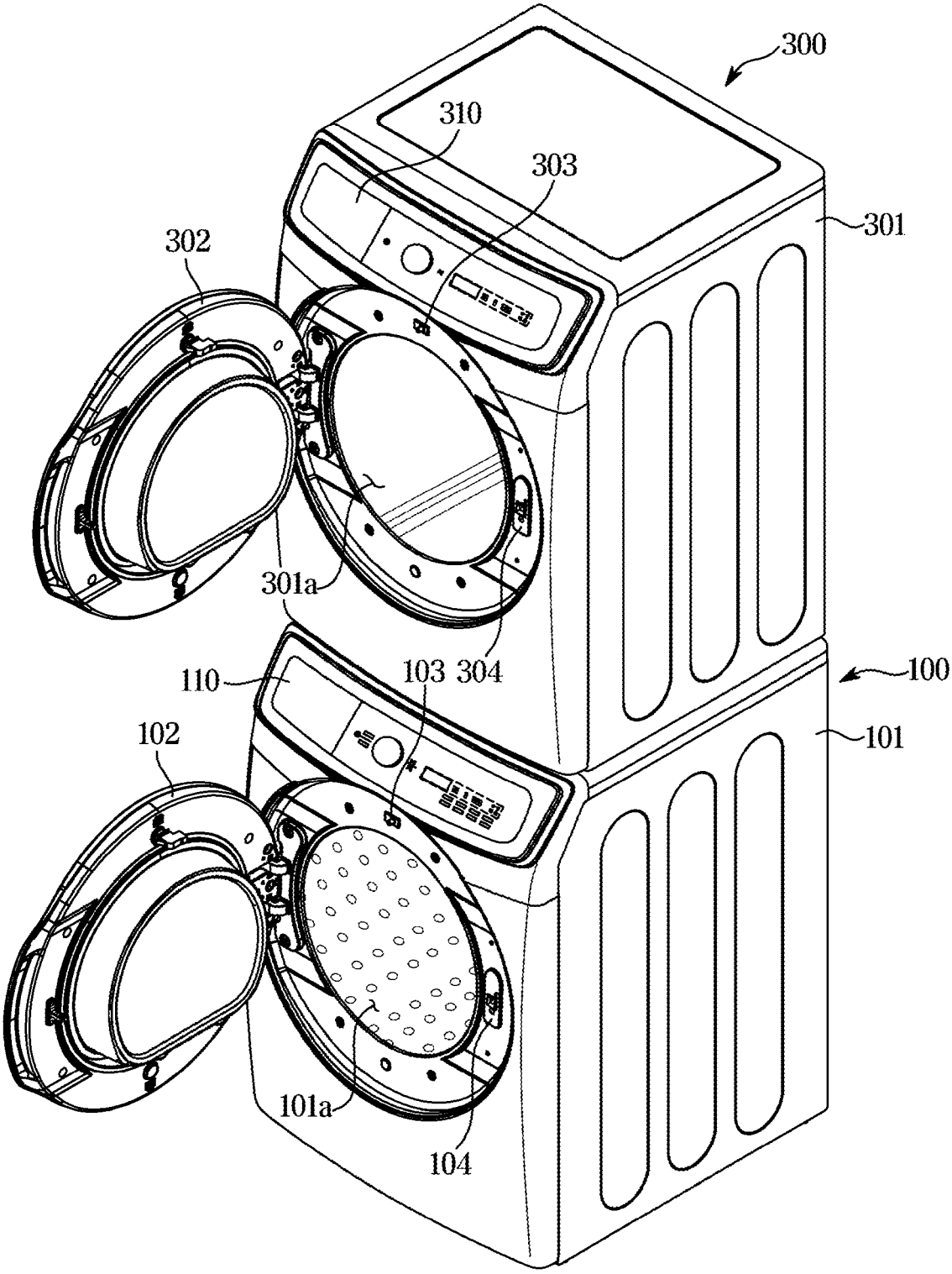
FIG. 2 is a view illustrating that a washing machine is arranged vertically with a drying machine according to an embodiment.

FIG. 1 is a view illustrating that a washing machine is arranged horizontally with a drying machine according to an embodiment. FIG. 2 is a view illustrating that a washing machine is arranged vertically with a drying machine according to an embodiment.

Referring to FIGS. 1 and 2, a washing machine 100 may be disposed adjacent to a drying machine 300. As such, because the washing machine 100 is disposed adjacent to the drying machine 300, a user may move laundry from the washing machine 100 to the drying machine 300 without lifting and moving the laundry.

As illustrated in FIG. 1, the washing machine 100 may be placed side by side (horizontally) with the drying machine 300. Because the washing machine 100 is placed side by side with the drying machine 300, the user may easily move the laundry from the washing machine 100 to the drying machine 300, as well as easily use a control panel of the washing machine 100 and a control panel of the drying machine 300. On the other hand, because the washing machine 100 is arranged side by side with the drying machine 300, the user's living space may be reduced.

Also, as illustrated in FIG. 2, the drying machine 300 may be disposed on the washing machine 100 (vertical). The washing machine 100 usually washes laundry (for example, clothes or shoes) using water, and thus a weight of the washing machine 100 may increase significantly during a washing operation. On the other hand, the drying machine 300 dries objects to be dried (e.g., clothing or shoes, etc.) using high-temperature dry hot air, so that a weight of the drying machine 300 does not change significantly during a drying operation. Thus, the relatively light drying machine 300 (during operation) may be placed on top of the washing machine 100.

Thus, because the drying machine 300 is disposed on top of the washing machine 100, a space occupied by the washing machine 100 and the drying machine 300 may be similar to a case where the washing machine 100 is used alone. In other words, the user's living space may not be significantly reduced due to the drying machine 300. However, because the drying machine 300 is placed on top of the washing machine 100, the control panel of the drying machine 300 is placed at a high position. As a result, some of the users may have difficulty using the control panel of the drying machine 300.

In order to prevent or reduce the user from having difficulty using the control panel of the drying machine 300 when the drying machine 300 is placed on top of the washing machine 100, or in order for the user to control the drying machine 300 and the washing machine 100 collectively when the drying machine 300 is placed side by side with the washing machine 100, the washing machine 100 may provide a user interface for controlling the drying machine 300 using the control panel of the washing machine 100. In other words, the user may control the drying machine 300 using the control panel of the washing machine 100.

In order for the washing machine 100 to provide the user interface for controlling the drying machine 300, the washing machine 100 may communicate with the drying machine 300 either by wire or wirelessly. For example, the washing machine 100 may not only obtain washing settings (e.g., washing temperature, number of rinsing times, dehydrating strength, etc.) for the washing operation from the user, but also obtain drying settings (e.g., degree of drying, additional time for preventing or reducing wrinkles, drying time, etc.) for the drying operation from the user. In addition, the washing machine 100 may transmit the drying settings obtained from the user to the drying machine 300 by wire or wirelessly, and the drying machine 300 may dry an object to be dried depending on the drying settings received from the washing machine 100.

Figure 3:
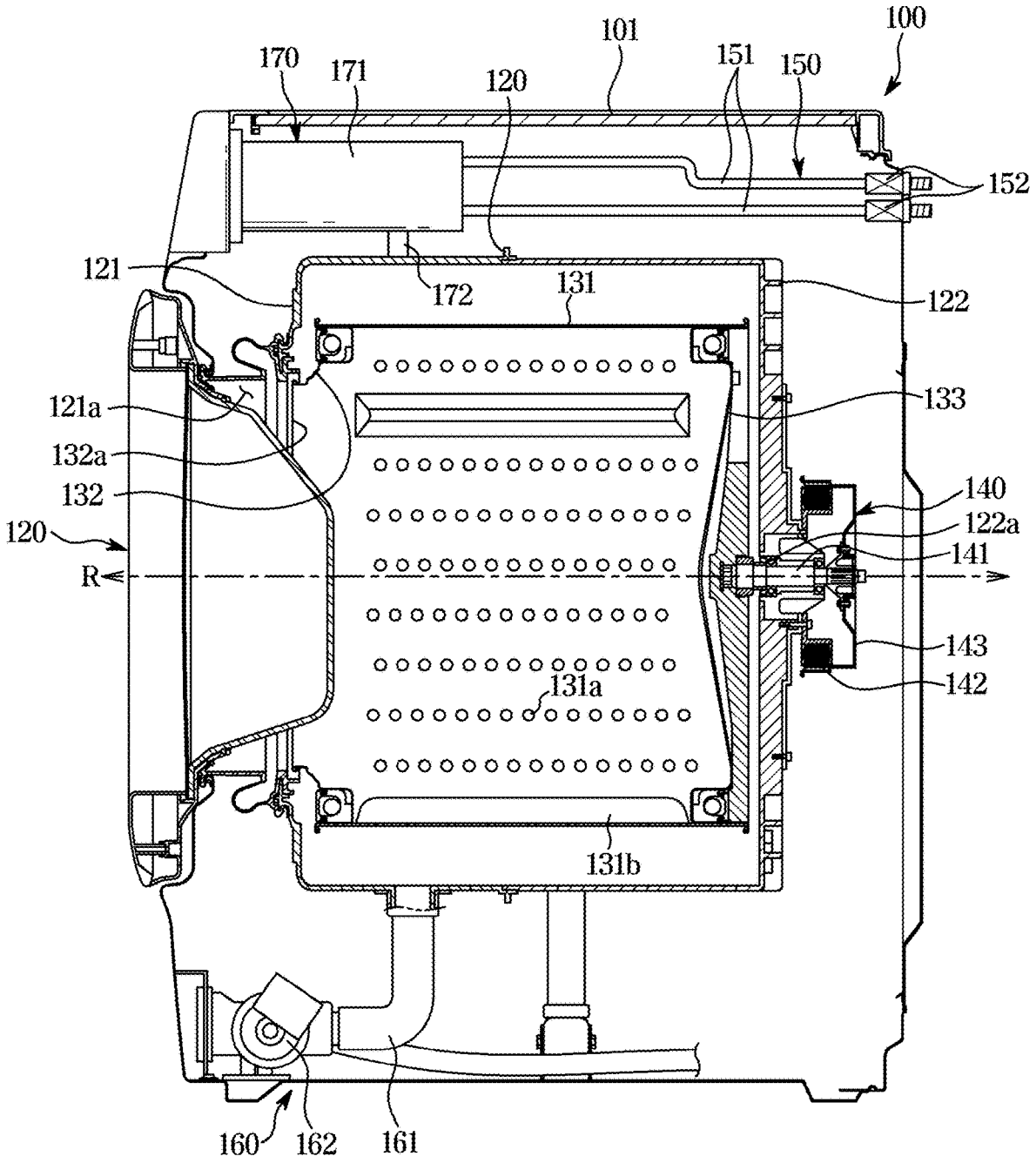
FIG. 3 is a view illustrating a side cross-section of a washing machine according to an embodiment.

FIG. 3 is a view illustrating a side cross-section of a washing machine according to an embodiment.

A configuration of the washing machine 100 will be described with reference to FIG. 3 and FIGS. 1 and 2 described above.

The washing machine 100 may include a cabinet 101. In addition, the washing machine 100 may further include a door 102, a control panel 110, a tub 120, a drum 130, a drum motor 140, a water supplier 150, a water drain 160, and a detergent supplier 170 accommodated in the cabinet 101.

At the center of a front surface of the cabinet 101, an inlet 101*a* may be formed to which laundry is put into or taken out of.

The door 102 may be provided in the inlet 101*a*. The door 102 is rotatably mounted to the cabinet 101 by a hinge.

The door 102 may open and close the inlet 101*a*. The closing of the inlet 101*a* by the door 102 may be detected by a door switch 103. When the inlet 101*a* is closed and the washing machine 100 is operated, the door 102 may be locked by a door lock 104.

The control panel 110 including a display configured to display operation information of the washing machine 100 and a user inputter configured to obtain a user input for the washing machine 100 from the user may be provided on a front upper side of the cabinet 101. The control panel 110 is described in more detail below.

The tub 120 may be provided inside the cabinet 101 and may accommodate water for washing and/or rinsing.

The tub 120 may include a tub front part 121 having an opening 121*a* formed at a front surface thereof, and a tub rear part 122 having a cylindrical shape with a closed rear surface thereof.

The front of the tub front part 121 is provided with the opening 121*a* for injecting laundry into the drum 130 provided in the tub 120 or withdrawing laundry from the drum 130.

A rear wall of the tub rear part 122 is provided with a bearing 122*a* for rotatably fixing the drum motor 140.

The drum 130 is rotatably provided in the tub 120 and may accommodate laundry.

The drum 130 may include a cylindrical drum body 131, a drum front part 132 provided at the front of the drum body 131, and a drum rear part 133 provided at the rear of the drum body 131.

The inner surface of the drum body 131 provides a through hole 131*a* connecting the inside of the drum 130 and the inside of the tub 120 and a lifter 131*b* for raising laundry to an upper portion of the drum 130 during the rotation of the drum 130. The drum front part 132 is provided with an opening 132*a* for injecting laundry into the drum 130 or withdrawing laundry from the drum 130. The drum rear part 133 may be connected to a shaft 141 of the drum motor 140 that rotates the drum 130.

The drum motor 140 is provided outside the tub rear part 122 of the tub 120 and is connected to the drum rear part 133 of the drum 130 through the shaft 141. The shaft 141 penetrates the tub rear part 122 and is rotatably supported by the bearing 122*a* provided in the tub rear part 122.

The drum motor 140 includes a stator 142 fixed to the outside of the tub rear part 122, and a rotor 143 rotatably provided and connected to the shaft 141. The rotor 143 may rotate through magnetic interaction with the stator 142, and the rotation of the rotor 143 may be transmitted to the drum 130 through the shaft 141.

The drum motor 140 may include, for example, a Brush-Less Direct Current Motor (BLDC Motor) or a Permanent Synchronous Motor (PMSM).

The water supplier 150 is provided above the tub 120 and may supply water to the tub 120/the drum 130.

The water supplier 150 includes a water supply conduit 151 connected to an external water supply source for supplying water to the tub 120, and a water supply valve 152 provided on the water supply conduit 151.

The water supply conduit 151 may extend from the external water supply source to a detergent compartment 171 and guide water to the tub 120 via the detergent compartment 171.

The water supply valve 152 may allow or block the water supply from the external water source to the tub 120 in response to an electrical signal. The water supply valve 152 may include, for example, a solenoid valve that opens and closes in response to the electrical signal.

The water drain 160 is provided below the tub 120 and may discharge the water contained in the tub 120/the drum 130 to the outside.

The water drain 160 may include a drain conduit 161 extending from the tub 120 to the outside of the cabinet 101 and a drain pump 162 provided on the drain conduit 161. The drain pump 162 may pump water from the drain conduit 161 outside the cabinet 101.

The detergent supplier 170 may be provided at the upper side of the tub 120 and may supply detergent to the tub 120/the drum 130.

The detergent supplier 170 may include the detergent compartment 171 for storing the detergent and a mixing conduit 172 connecting the detergent compartment 171 with the tub 120.

The detergent compartment 171 is connected to the water supply conduit 151 and the water supplied through the water supply conduit 151 may be mixed with the detergent in the detergent compartment 171. The mixture of the detergent and water may be supplied to the tub 120 through the mixing conduit 172.

Figure 4:
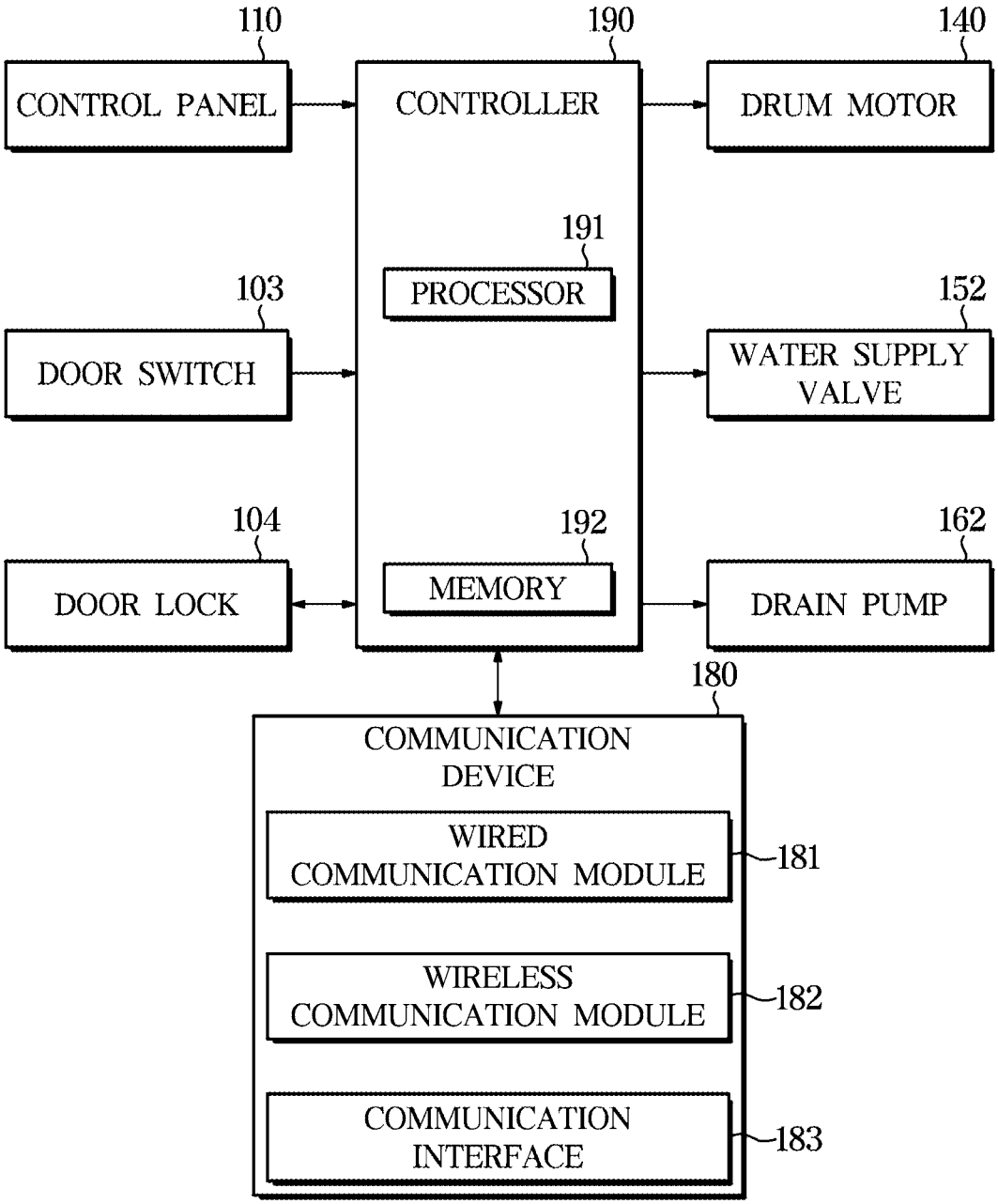
FIG. 4 is a view illustrating a configuration of a washing machine according to an embodiment.
Figure 5:
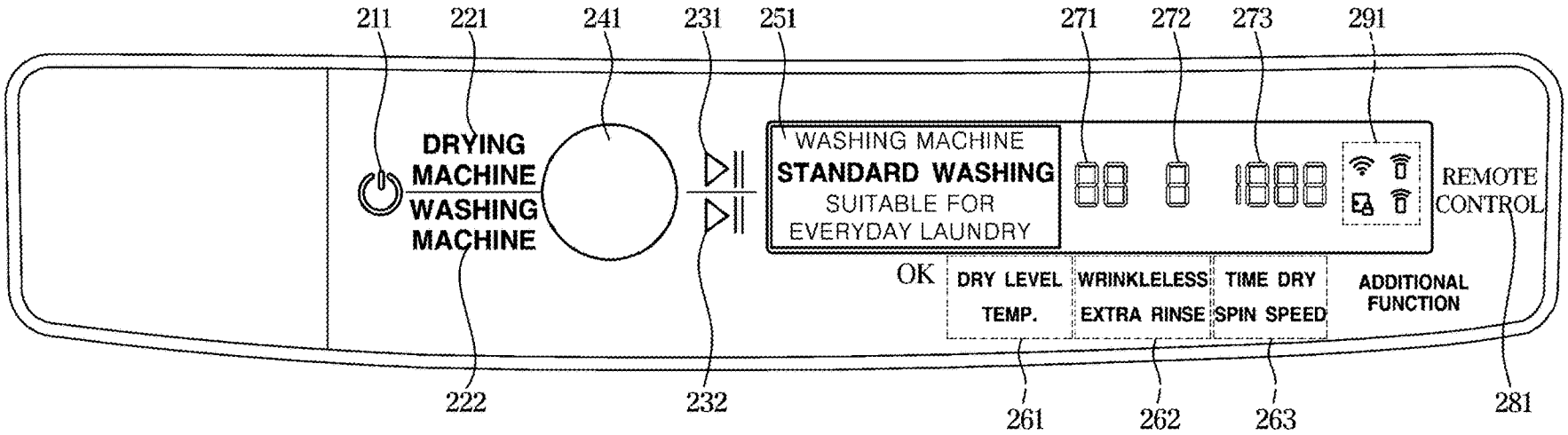
FIG. 5 is a view illustrating a control panel included in a washing machine according to an embodiment.
Figure 6:
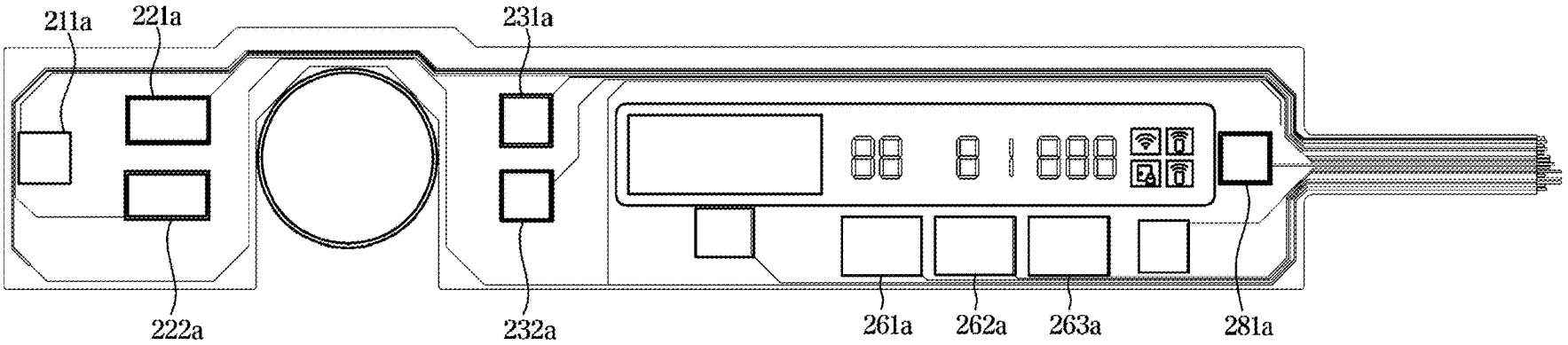
FIG. 6 is a view illustrating a touch panel of a control panel included in a washing machine according to an embodiment.
Figure 7:
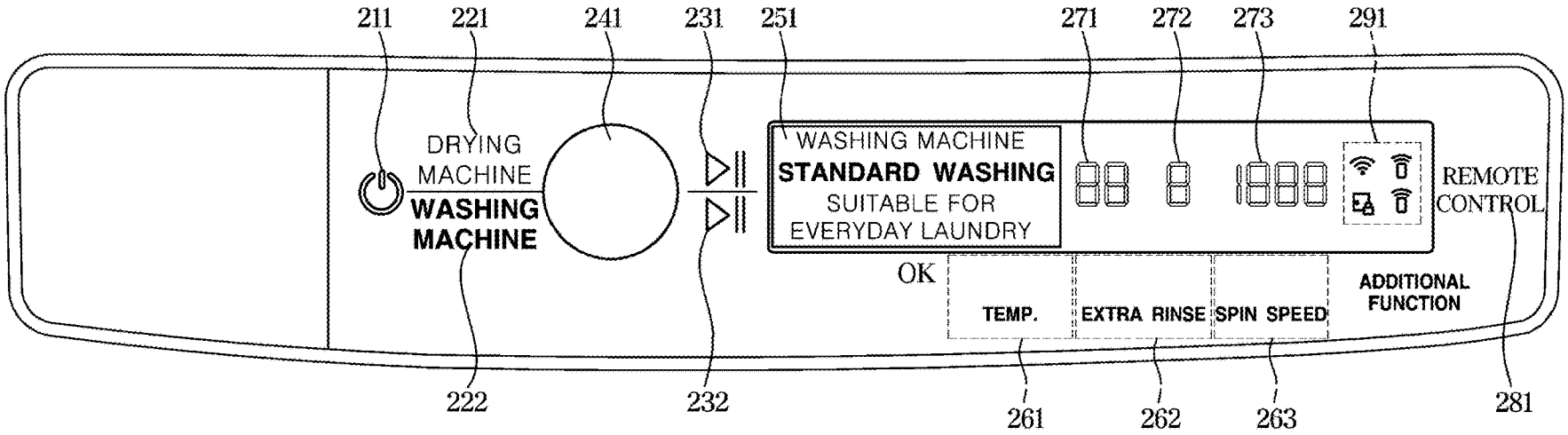
FIG. 7 is a view illustrating a first user interface of a control panel included in a washing machine according to an embodiment.
Figure 8:
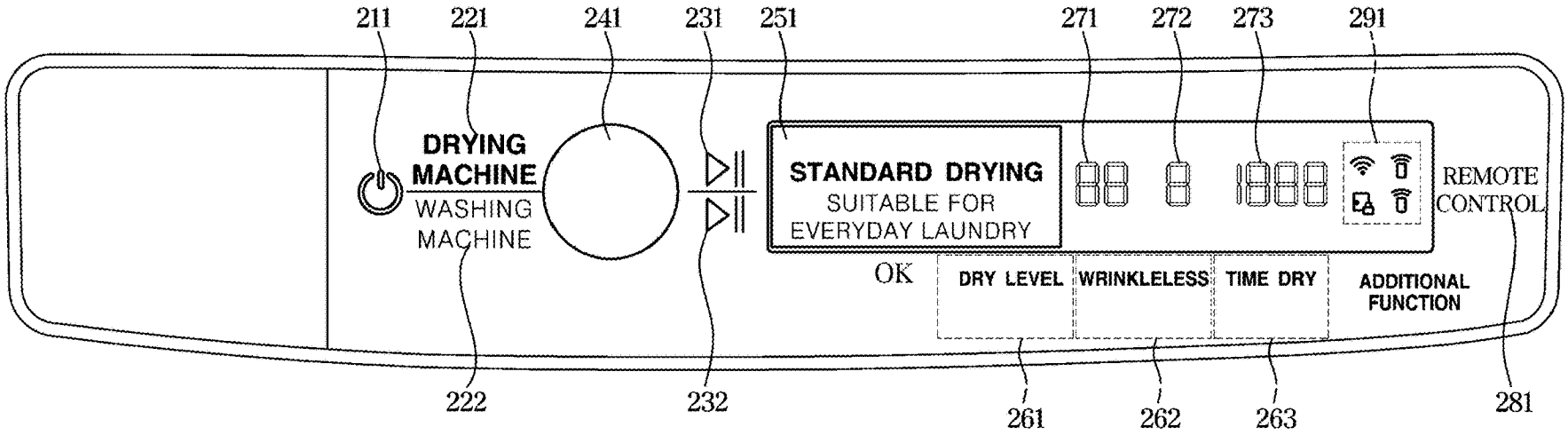
FIG. 8 is a view illustrating a second user interface of a control panel included in a washing machine according to an embodiment.
Figure 9:
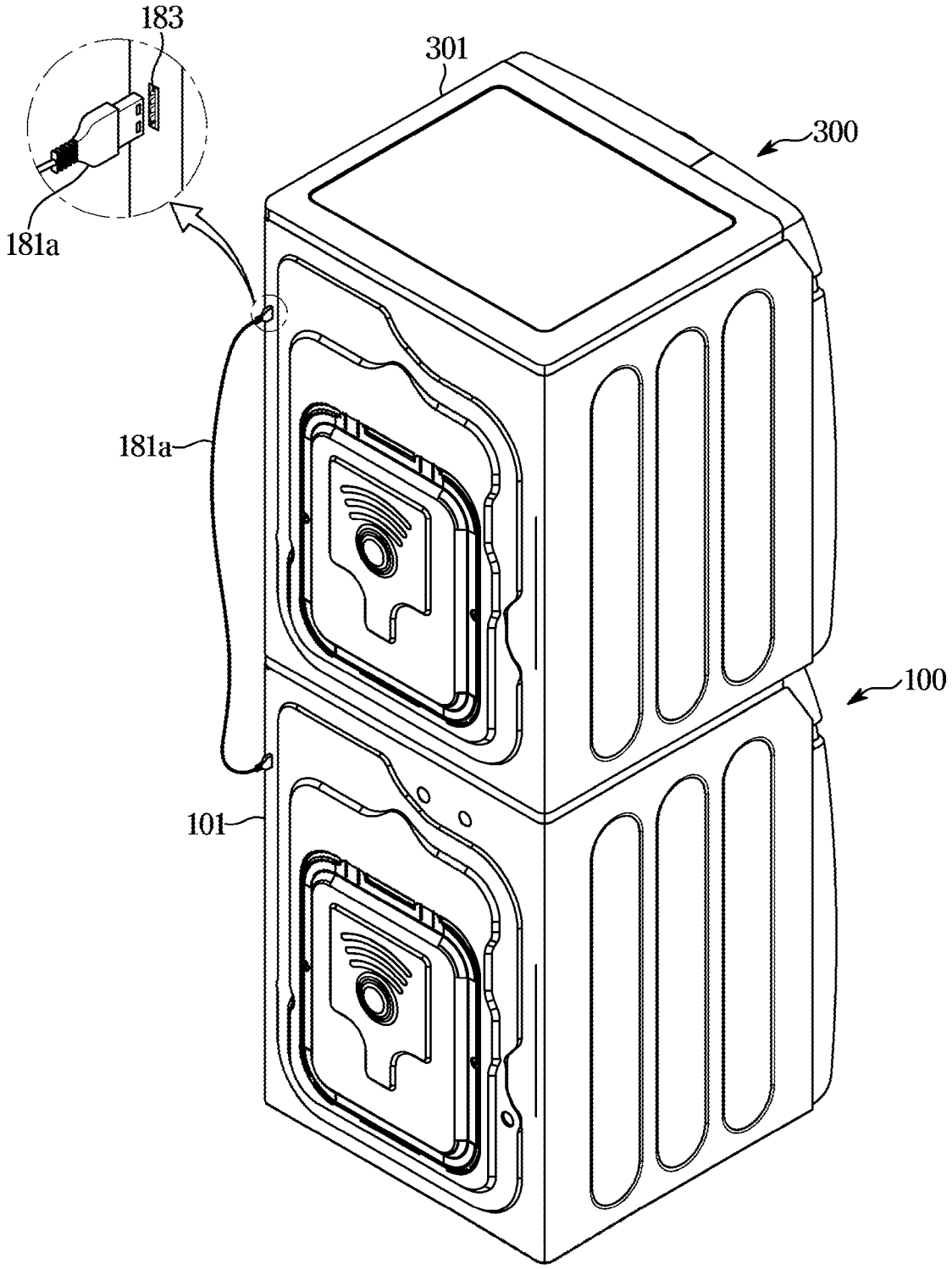
FIG. 9 is a view illustrating an example in which a washing machine is connected to a drying machine by wire according to an embodiment.
Figure 10:
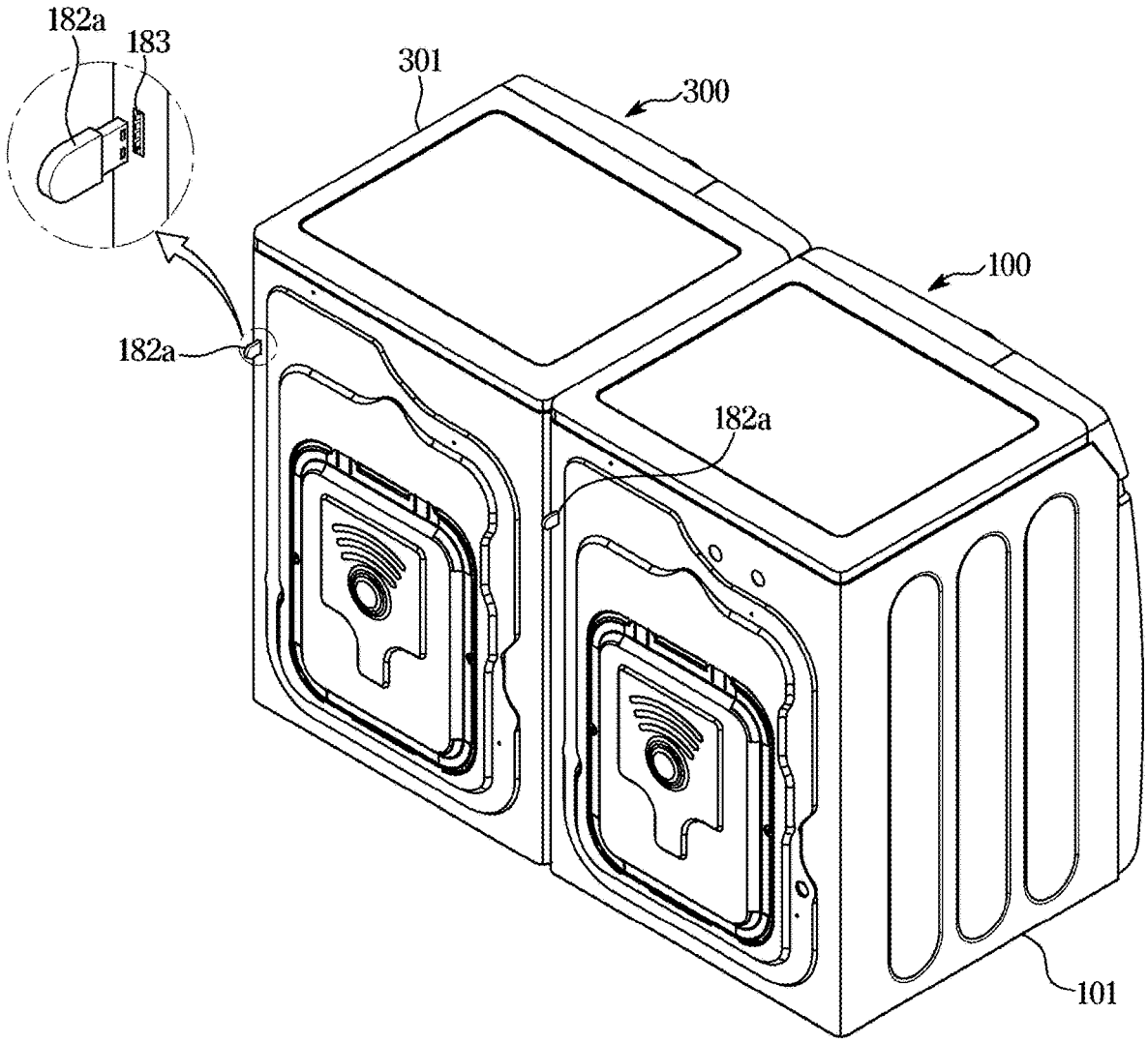
FIG. 10 is a view illustrating an example in which a washing machine is wirelessly connected to a drying machine according to an embodiment.

FIG. 4 is a view illustrating a configuration of a washing machine according to an embodiment. FIG. 5 is a view illustrating a control panel included in a washing machine according to an embodiment. FIG. 6 is a view illustrating a touch panel of a control panel included in a washing machine according to an embodiment. FIG. 7 is a view illustrating a first user interface of a control panel included in a washing machine according to an embodiment. FIG. 8 is a view illustrating a second user interface of a control panel included in a washing machine according to an embodiment. FIG. 9 is a view illustrating an example in which a washing machine is connected to a drying machine by wire according to an embodiment. FIG. 10 is a view illustrating an example in which a washing machine is wirelessly connected to a drying machine according to an embodiment.

The washing machine 100 may further include the following electrical components as well as mechanical components described with reference to FIG. 3. The washing machine 100 may include the drum motor 140, the water supply valve 152, the drain pump 162, the door switch 103, the door lock 104, the control panel 110, a communication device 180, and a controller 190.

The drum motor 140 may rotate the drum 130 in response to a driving signal from the controller 190. For example, the drum motor 140 may receive a reference speed from the controller 190 and rotate the drum 130 so that a rotational speed of the drum 130 follows the reference speed of the controller 190.

The water supply valve 152 may maintain a normally closed state and may be opened in response to a water supply signal from the controller 190. By opening the water supply valve 152, water can be supplied to the tub 120 through the water supply conduit 151.

The drain pump 162 may pump water from the drain conduit 161 out of the cabinet 101 in response to a drain signal from the controller 190. By pumping the drain pump 162, water accommodated in the tub 120 may be discharged to the outside of the cabinet 101 through the drain conduit 161.

The door switch 103 may detect a state in which the door 102 is closed and a state in which the door 102 is open, respectively. For example, the door switch 103 may be opened (off) when the door 102 is open, and the door switch 103 may be closed (on) when the door 102 is closed. The door switch 103 may provide a signal indicating the closed state of the door 102 or a signal indicating the open state of the door 102 to the controller 190.

The door lock 104 may lock the door 102 in response to a lock signal from the controller 190. For example, when the door 102 closes the inlet 101*a* and the washing machine 100 operates, the controller 190 may control the door lock 104 to lock the door 102.

The control panel 110 may include the user inputter for obtaining the user input, and the display for displaying the washing setting and/or washing operation information in response to the user input. In other words, the control panel 110 may provide an interface (hereinafter referred to as 'user interface') for the user and the washing machine 100 to interact.

The control panel 110 may include a washer power button 211 for obtaining the user input for powering on the washing machine 100 or obtaining the user input for powering off the washing machine 100, as illustrated in FIG. 5.

In relation to the power source, the washing machine 100 may be placed in three states including an "off state," a "standby state," and an "on state," and may perform different operations depending on a power state of the washing machine 100.

The washing machine 100 may be placed in the "off state" where a plug is not inserted into a power socket. In the "off state," no power is supplied to a display device, and the washing machine 100 may not perform any operation.

The washing machine 100 may be placed in the "standby state" in which the plug is inserted into the power socket and the user's power-on command (for example, touching a power button) is not input. In the "standby state," some of the components included in the washing machine 100 may be powered. For example, in the "standby state," power may be supplied to a part of the control panel 110, the communication device 180, and the controller 190.

The washing machine 100 may be placed in the "on state" where the plug is inserted into the power socket and the user's power-on command (e.g., action of touching the power button) is input. In the "on state," the power may be supplied to all of the components included in the washing machine 100.

When the washer power button 211 is touched or pressed by the user while the plug of the washing machine 100 is inserted into the socket, the washing machine 100 may be switched from the "standby state" to the "on state" and the power is supplied to all the components included in the washing machine 100, and all functions of the washing machine 100 may be activated. When the washer power button 211 is touched or pressed by the user in the "on state," the washing machine 100 may be switched from the "on state" to the "standby state" and many functions of the washing machine 100 may be deactivated.

The washer power button 211 may include a tact switch, a push switch, a slide switch, a toggle switch, a micro switch, or a touch switch. For example, as illustrated in FIG. 6, the washer power button 211 may include a first touch switch 211*a* for obtaining the user's touch input, and the first touch switch 211*a* may be connected to the controller 190.

The washer power button 211 may display the power state of the washing machine 100. For example, in the "on state," the washer power button 211 may emit light, and in the 'standby state,' the washer power button 211 may not emit light. The washer power button 211 may further include a first light emitting diode that emits light depending on, for example, the power state of the washing machine 100.

The control panel 110 may further include a dryer control button 221 that obtains the user input to activate a dryer control for controlling the drying machine 300 and a washer control button 222 that obtains the user input to activate a washer control for controlling the washing machine 100 as illustrated in FIG. 5. As illustrated in FIG. 5, the washer control button 222 can be disposed under the dryer control button 221 on the control panel.

As described above, the washing machine 100 may provide a first user interface for controlling the washing machine 100 and a second user interface for controlling the drying machine 300 using one of the control panels 110. The washing machine 100 may operate in a dryer control mode for obtaining the user input to the drying machine 300 or in a washer control mode for obtaining the user input to the washing machine 100 in order to provide a plurality of user interfaces using one of the control panels 110.

The washing machine 100 may provide the dryer control button 221 and the washer control button 222 so that the user can select the dryer control or the washer control. In response to the dryer control button 221 being touched or pressed, the washing machine 100 may operate in the dryer control mode for obtaining the user input to the drying machine 300. In other words, the washing machine 100 may provide the user with the first user interface for obtaining the user input to the drying machine 300 using the control panel 110.

In addition, in response to the washer control button 222 being touched or pressed, the washing machine 100 may operate in the washer control mode that obtains the user input to the washing machine 100. In other words, the washing machine 100 may provide the user with the second user interface for obtaining the user input to the washing machine 100 using the control panel 110.

For example, as illustrated in FIG. 6, the dryer control button 221 may include a second touch switch 221*a*, and the washer control button 222 may include a third touch switch 222*a*. The second touch switch 221*a* and the third touch switch 222*a* may be respectively connected to the controller 190.

The dryer control button 221 and the washer control button 222 may respectively display the control mode of the control panel 110. For example, when the control panel 110 operates in the dryer control mode, the dryer control button 221 may emit light and the washer control button 222 may not emit light as illustrated in FIG. 7. In addition, when the control panel 110 operates in the washer control mode, as illustrated in FIG. 8, the washer control button 222 may emit light and the dryer control button 221 may not emit light. For example, the dryer control button 221 may further include a second light emitting diode that emits light depending on the dryer control mode of the control panel 110, and the washer control button 222 may further include a third light emitting diode that emits light depending on the washer control mode of the control panel 110.

The control panel 110 may further include a drying operation button 231 that obtains the user input for starting the drying operation of the drying machine 300 or pausing the drying operation, and a washing operation button 232 that obtains the user input for starting the washing operation of the washing machine 100 or pausing the washing operation, as illustrated in FIG. 5. As illustrated in FIG. 5, the operation washing operation button 232 can be disposed under the drying operation button on the control panel 110.

As described above, in the dryer control mode, the washing machine 100 may obtain the user input related to the drying operation of the drying machine 300 through the button included in the control panel 110. In the washer control mode, the washing machine 100 may obtain the user input related to the washing operation of the washing machine 100 through the button included in the control panel 110. In other words, the washing machine 100 may obtain the user input for controlling the drying machine 300 in the dryer control mode, and the user input for controlling the washing machine 100 in the washer control mode.

In comparison, the drying operation button 231 may obtain the user input to start or pause the drying operation of the drying machine 300 regardless of the control mode. Particularly, the drying operation button 231 may not only obtain the user input for starting or pausing the drying operation of the drying machine 300 in the dryer control mode, but also obtain the user input for starting or pausing the drying operation of the drying machine 300 in the washer control mode.

Thereby, the user may quickly stop the operation of the drying machine 300 in an urgent situation. For example, in order to input an additional object to be dried into the drying machine 300 in operation, the user may pause the operation of the drying machine 300 by directly touching the drying operation button 231 without touching the dryer control button 221 to switch from the washer control mode to the dryer control mode.

The washing operation button 232 may also obtain the user input for starting the washing operation of the washing machine 100 or pausing the washing operation regardless of the control mode. Particularly, the washing operation button 232 may not only obtain the user input for starting or pausing the washing operation of the washing machine 100 in the washer control mode, but also obtain the user input for starting or pausing the washing operation of the washing machine 100 in the dryer control mode.

The drying operation button 231 and the washing operation button 232 may each include a push switch, a slide switch, a toggle switch, a micro switch, or a touch switch. For example, as illustrated in FIG. 6, the drying operation button 231 may include a fourth touch switch 231*a*, and the washing operation button 232 may include a fifth touch switch 232*a*. The fourth touch switch 231*a* and the fifth touch switch 232*a* may be connected to the controller 190, respectively.

The drying operation button 231 and the washing operation button 232 may display whether the drying machine 300 is operating and whether the washing machine 100 is operating, respectively. For example, when the drying machine 300 is in operation, the drying operation button 231 may emit light. In addition, when the washing machine 100 is operating, the washing operation button 232 may emit light. For example, the drying operation button 231 may further include a fourth light emitting diode that emits light depending on whether the drying machine 300 is operating. The washing operation button 232 may further include a fifth light emitting diode that emits light depending on whether the washing machine 100 is operating.

The control panel 110 may further include a course selection dial 241 and a course display 251 as illustrated in FIG. 5.

The course selection dial 241 may obtain the user input for selecting a drying course in the dryer control mode and the user input for selecting a washing course in the washer control mode. The course display 251 may display the drying course selected by the rotation of the course selection dial 241 in the dryer control mode, and may display the washing course selected by the rotation of the course selection dial 241 in the washer control mode.

Here, the drying course may include the drying settings (e.g., degree of drying, additional time for preventing or reducing wrinkles, drying time, etc.) preset by a designer of the drying machine 300 according to the type of object to be dried (for example, quilt, underwear, etc.) and material (for example, wool, etc.). For example, standard drying may include the drying setting that can be applied to most objects to be dried, and quilt drying may include the drying setting optimized for drying a quilt.

The drying course may be classified into, for example, standard drying, synthetic fiber drying, wool drying, delicate drying, quilt drying, towel drying, small load drying, shelf drying, dusting, and the like.

The course selection dial 241 may obtain the user input (dial rotation) for selecting one drying course among a plurality of the drying courses in the dryer control mode. Further, the course display 251 may display the plurality of drying courses in a predetermined order depending on the rotation of the course selection dial 241 in the dryer control mode. The drying course displayed on the course display 251 when the rotation of the course selection dial 241 is stopped may be selected as a course for drying the object to be dried.

The washing course may include the washing settings (e.g., washing temperature, number of rinsing times, dehydrating strength, etc.) preset by the designer of the washing machine 100 according to the type of object to be dried (for example, quilt, underwear, etc.) and the material (for example, wool, etc.). For example, standard washing may include the washing settings that can be applied to most laundry, and quilt washing may include the washing setting optimized for washing quilts.

The washing course may be classified into, for example, standard washing, strong washing, wool washing, duvet washing, baby clothes washing, towel washing, small load washing, boiled washing, power saving washing, outdoor washing, rinsing/dehydrating, dehydrating, and the like.

The course selection dial 241 may obtain the user input (dial rotation) for selecting one washing course among a plurality of the washing courses in the washer control mode. Also, the course display 251 may display the plurality of washing courses in a predetermined order depending on the rotation of the course selection dial 241 in the washer control mode. The washing course displayed on the course display 251 when the rotation of the course selection dial 241 is stopped may be selected as a course for washing laundry.

The course display 251 may display operation information of the drying machine 300 in operation in the dryer control mode. For example, the course display 251 may display the time remaining until the end of the drying operation of the drying machine 300 in the dryer control mode.

Further, the course display 251 may display operation information of the washing machine 100 in operation in the washer control mode. For example, the course display 251 may display the time remaining until the end of the washing operation of the washing machine 100 in the washer control mode.

When both the drying machine 300 and the washing machine 100 are in operation, the course display 251 may display both the time remaining until the end of the drying operation of the drying machine 300 and the time remaining until the end of the washing operation of the washing machine 100.

The course display 251 may include, for example, a liquid crystal display (LCD) panel, a light emitting diode (LED) panel, and the like.

The control panel 110 may include a plurality of setting buttons 261, 262 and 263 and a plurality of setting displays 271, 272 and 273 as illustrated in FIG. 5. The control panel 110 may include the first setting button 261, the first setting display 271, the second setting button 262, the second setting display 272, the third setting button 263, and the third setting display 273 as illustrated in FIG. 5.

The first setting button 261 may obtain the user input for selecting drying information in the dryer control mode and the user input for selecting the washing temperature in the washer control mode. The first setting display 271 may display the drying information selected through the first setting button 261 in the dryer control mode and the washing temperature selected through the first setting button 261 in the washer control mode.

The first setting button 261 may include a sixth touch switch 261*a* as illustrated in FIG. 6, and the sixth touch switch 261*a* may be connected to the controller 190.

The first setting button 261 may display text or symbol meaning 'degree of drying' in the dryer control mode, and text or symbol meaning 'washing temperature' in the washer control mode. For example, in the dryer control mode, as illustrated in FIG. 7 on the first setting button 261, the text 'degree of drying' may be displayed on a part of the first setting button 261, and in the washer control mode, as illustrated in FIG. 8, the text 'washing temperature' may be displayed on another part of the first setting button 261.

The first setting button 261 may include a sixth upper light emitting diode that emits light so that the text 'degree of drying' is displayed in the dryer control mode, and a sixth lower light emitting diode that emits light so that the text 'washing temperature' is displayed in the washer control mode.

In the dryer control mode, the first setting display 271 may display the selected degree of drying (for example, text or numbers indicating the drying degree, such as 1, 2, or 3) depending on the number of touches of the first setting button 261. In addition, in the washer control mode, the first setting display 271 may display the selected washing temperature (for example, text and numbers indicating the washing temperature such as 30 degrees, 40 degrees or 50 degrees, etc.) depending on the number of touches of the first setting button 261.

The first setting display 271 may include, for example, a 7-segment display as illustrated in FIG. 6.

The second setting button 262 may obtain the user input for selecting an additional time for preventing or reducing wrinkles in the dryer control mode and the user input for selecting a number of rinsing times in the washer control mode. The second setting display 272 may display the additional time for preventing or reducing wrinkles selected through the second setting button 262 in the dryer control mode and the number of rinsing times selected through the second setting button 262 in the washer control mode.

The second setting button 262 may include a seventh touch switch 262*a* as illustrated in FIG. 6, and the seventh touch switch 262*a* may be connected to the controller 190.

The second setting button 262 may display text or symbol meaning 'anti-wrinkle' in the dryer control mode, and text or symbol meaning 'number of rinsing times' in the washer control mode. For example, in the dryer control mode, as illustrated in FIG. 7 on the second setting button 262, the text 'anti-wrinkle' may be displayed on a part of the second setting button 262, and in the washer control mode, as illustrated in FIG. 8, the text 'number of rinsing times' may be displayed on another part of the second setting button 262.

The second setting button 262 may include a seventh upper light emitting diode that emits light so that the text 'anti-wrinkle' is displayed in the dryer control mode, and a seventh lower light emitting diode that emits light so that the text 'number of rinsing times' is displayed in the washer control mode.

In the dryer control mode, the second setting display 272 may display the selected additional time for preventing or reducing wrinkles (for example, text and numbers indicating the additional time such as 1 hour, 2 hours, or 3 hours) depending on the number of touches of the second setting button 262. In addition, in the washer control mode, the second setting display 272 may display the selected number of rinsing times (or text and numbers indicating the number of rinsing times, such as once, twice, or three times) depending on the number of touches of the second setting button 262.

The second setting display 272 may include, for example, a 7-segment display as illustrated in FIG. 6.

The third setting button 263 may obtain the user input for selecting the drying time in the dryer control mode and the user input for selecting the dehydrating strength in the washer control mode. The third setting display 273 may display the drying time selected through the third setting button 263 in the dryer control mode and the dehydrating strength selected through the third setting button 263 in the washer control mode.

The third setting button 263 may include an eighth touch switch 263*a* as illustrated in FIG. 6, and the eighth touch switch 263*a* may be connected to the controller 190.

The third setting button 263 may display text or symbol meaning 'time setting' in the dryer control mode, and text or symbol meaning 'dehydrating strength' in the washer control mode. For example, in the dryer control mode, as illustrated in FIG. 7 on the third setting button 263, the text 'time setting' may be displayed on a part of the third setting button 263, and in the washer control mode, as illustrated in FIG. 8, the text 'dehydrating strength' may be displayed on another part of the third setting button 263.

The third setting button 263 may include an eighth upper light emitting diode that emits light so that the text 'time setting' is displayed in the dryer control mode, and an eighth lower light emitting diode that emits light so that the text 'dehydrating strength' is displayed in the washer control mode.

In the dryer control mode, the third setting display 273 may display the selected drying time (for example, text and numbers indicating the additional time such as 1 hour, 2 hours, or 3 hours) depending on the number of touches of the third setting button 263. In addition, in the washer control mode, the third setting display 273 may display the dehydrating strength (or text and numbers indicating the dehydrating strength such as 1, 2, or 3) depending on the number of touches of the third setting button 263.

The third setting display 273 may include, for example, a 7-segment display as illustrated in FIG. 6.

As such, each of the first, second, and third setting buttons 261, 262, and 263 may be implemented as a single touch switch, and may obtain different user inputs in different control modes. On each of the first, second, and third setting buttons 261, 262, and 263, text or symbols indicating the different user inputs may be displayed in the different control modes.

In addition, each of the first, second, and third setting displays 271, 272, and 273 may display different information in different control modes.

The control panel 110 may include a remote control button 281 and an additional setting display 291 as illustrated in FIG. 5.

The remote control button 281 may obtain the user input for activating or inactivating remote control of the drying machine 300 and/or the washing machine 100 by an external device such as a user device in the dryer control mode and the washer control mode. The remote control button 281 may include a ninth touch switch 281*a* as illustrated in FIG. 6, and the ninth touch switch 281*a* may be connected to the controller 190. Also, the remote control button 281 may emit light in the dryer control mode and the washer control mode.

The additional setting display 291 may display whether the remote control of the drying machine 300 is activated, whether the remote control of the washing machine 100 is activated, and the like. The additional setting display 291 may include, for example, an LCD panel, an LED panel, and the like.

As such, the control panel 110 may include a plurality of buttons and a plurality of displays. The plurality of buttons may obtain the different user inputs in the different control modes, and the plurality of displays may display different information in the different control modes.

The communication device 180 may transmit data to the drying machine 300 and receive data from the drying machine 300.

The communication device 180 may include a wired communication module 181 that exchanges data with the drying machine 300 by wire, a wireless communication module 182 that exchanges data with the drying machine 300 wirelessly, and a communication interface 183 that is a passage for exchanging data with the drying machine 300.

The wired communication module 181 may exchange data with the drying machine 300 using various wired communication standards.

For example, the wired communication module 181 may exchange data with the drying machine 300 through a universal asynchronous receiver/transmitter (UART). The wired communication module 181 may exchange data with the drying machine 300 using a communication standard such as RS-422 or RS-485 through the UART. In addition, the wired communication module 181 may exchange data with the drying machine 300 using Ethernet (IEEE 802.3 technology standard).

The wired communication module 181 may include a communication circuit (e.g., a network interface controller) including a processor and/or memory for modulating/demodulating data for wired communication.

The wireless communication module 182 may exchange data with the drying machine 300 using various wireless communication standards.

For example, the wireless communication module 182 may connect to a wireless repeater using Wi-Fi (WiFi™, IEEE 802.11 technology standard) wireless communication and exchange data with the drying machine 300 through the wireless repeater. The Wi-Fi wireless communication may provide peer to peer communication between nodes (e.g., the display device and an audio device) without going through the wireless repeater. As such, the peer to peer communication using Wi-Fi wireless communication is referred to as "WiFi P2P" or "WiFi direct." The wireless communication module 182 may exchange data with the drying machine 300 using a Wi-Fi P2P communication standard.

In addition, the wireless communication module 182 may exchange data with the drying machine 300 using Bluetooth (Bluetooth™, IEEE 802.15.1 technology standard) or ZigBee™ (IEEE 802.15.4 technology standard) wireless communication. Alternatively, the wireless communication module 182 may exchange data with the drying machine 300 using Near Field Communication (NFC).

The wireless communication module 182 may include a communication circuit (e.g., a wireless network interface controller) including a processor and/or memory for decoding/encoding data for wireless communication.

The communication interface 183 may form a wired or wireless channel for exchanging data with the drying machine 300.

For example, as illustrated in FIGS. 9 and 10, the communication interface 183 may be provided on the rear side of the cabinet 101 so that it is not visible to the user. The communication interface 183 may be implemented as a connection terminal through which a communication line 181*a* or a wireless dongle 182*a* can be inserted.

For example, when the communication line 181*a* is connected to the communication interface 183 as illustrated in FIG. 9, the wired communication module 181 may be activated, and the wired communication module 181 may exchange data with the drying machine 300 by wire through the communication interface 183 and the communication line 181*a*.

As another example, when the wireless dongle 182*a* for wireless communication is connected to the communication interface 183 as illustrated in FIG. 10, the wireless communication module 182 may be activated, and the wireless communication module 182 may exchange data with the drying machine 300 by wire through the communication interface 183 and the wireless dongle 182*a*.

The communication interface 183 may have various types of connectors. For example, the communication interface 183 may include a universal serial bus (USB) terminal or an RJ-45 terminal.

The controller 190 may be mounted on a printed circuit board provided on the rear side of the control panel 110, for example.

The controller 190 may be electrically connected to the drum motor 140, the water supply valve 152, the drain pump 162, the door switch 103, the door lock 104, the control panel 110, and the communication device 180.

The controller 190 includes a processor 191 for generating a control signal for controlling the operation of the washing machine 100, and a memory 192 for memorizing or storing a program and data for generating a control signal for controlling the operation of the washing machine 100. The processor 191 and the memory 192 may be implemented as separate chips or as a single chip. In addition, the controller 190 may include a plurality of processors or a plurality of memories.

The processor 191 may process data and/or signals according to a program provided from the memory 192, and provide a control signal to each component of the washing machine 100 based on a processing result.

The processor 191 may receive the user input from the control panel 110 and process the user input.

The processor 191, in response to the user input, may operate in the dryer control mode for controlling the drying operation of the drying machine 300 and changing the drying setting, or the washer control mode for controlling the washing operation of the washing machine 100 and changing the washing setting. For example, the processor 191, based on the user input through the dryer control button 221, may provide communication data to the communication device 180 for switching to the dryer control mode and changing the drying setting of the drying machine 300. In addition, the processor 191, based on the user input through the washer control button 222, may switch to the washer control mode and change the washing setting of the washing machine 100.

The processor 191 may control the control panel 110 to display the washing setting (or drying setting) and the washing operation information (or drying operation information) in response to the user input. For example, the processor 191 may control the control panel 110 to display the drying operation information or the drying settings of the drying machine 300 based on the user input through the dryer control button 221. Further, the processor 191 may control the control panel 110 to display the washing operation information or the washing settings of the washing machine 100 based on the user input through the washer control button 222.

The processor 191 may control the drum motor 140, the water supply valve 152, the drain pump 162, and the door lock in response to the user input. The processor 191 may set the washing settings in response to the user input through the course selection dial 241, the first setting button 261, the second setting button 262, and the third setting button 263, and may control the drum motor 140, the water supply valve 152, the drain pump 162 and the door lock 104 based on the washing setting. For example, the processor 191 may control the drum motor 140, the water supply valve 152, the drain pump 162, and the door lock 104 to sequentially perform a washing process, a rinsing process, and a dehydrating process.

The processor 191 may provide communication data to the communication device 180 to control the operation of the drying machine 300 in response to the user input. The processor 191 may set the drying settings in response to the user input through the course selection dial 241, the first setting button 261, the second setting button 262, and the third setting button 263, and may provide the drying setting to the communication device 180 so as to transmit information about the drying setting to the drying machine 300.

The processor 191 may include an operation circuit, a memory circuit, and a control circuit. The processor 191 may include one chip or may include a plurality of chips. In addition, the processor 191 may include one core or may include a plurality of cores.

The memory 192 may memorize/store data including a program for controlling the washing operation according to the washing course, and data including the washing settings according to the washing course and the drying settings according to the drying course. Also, the memory 192 may memorize/store the currently selected washing course, washing setting, drying course, and drying setting based on the user input.

The memory 192 may include a volatile memory such as Static Random Access Memory (S-RAM) and Dynamic Random Access Memory (D-RAM), and a non-volatile memory such as Read Only Memory (ROM) and Erasable Programmable Read Only Memory (EPROM). The memory 192 may include one memory element or a plurality of memory elements.

As described above, the washing machine 100 may provide the first user interface for controlling the operation of the drying machine 300 and the second user interface for controlling the operation of the washing machine 100 using one of the control panels 110. The washing machine 100 may transmit the communication data for controlling the drying operation of the drying machine 300 to the drying machine 300 based on the user input received through the first user interface. Further, the washing machine 100 may provide a control signal for controlling the washing operation based on the user input received through the second user interface.

Figure 11:
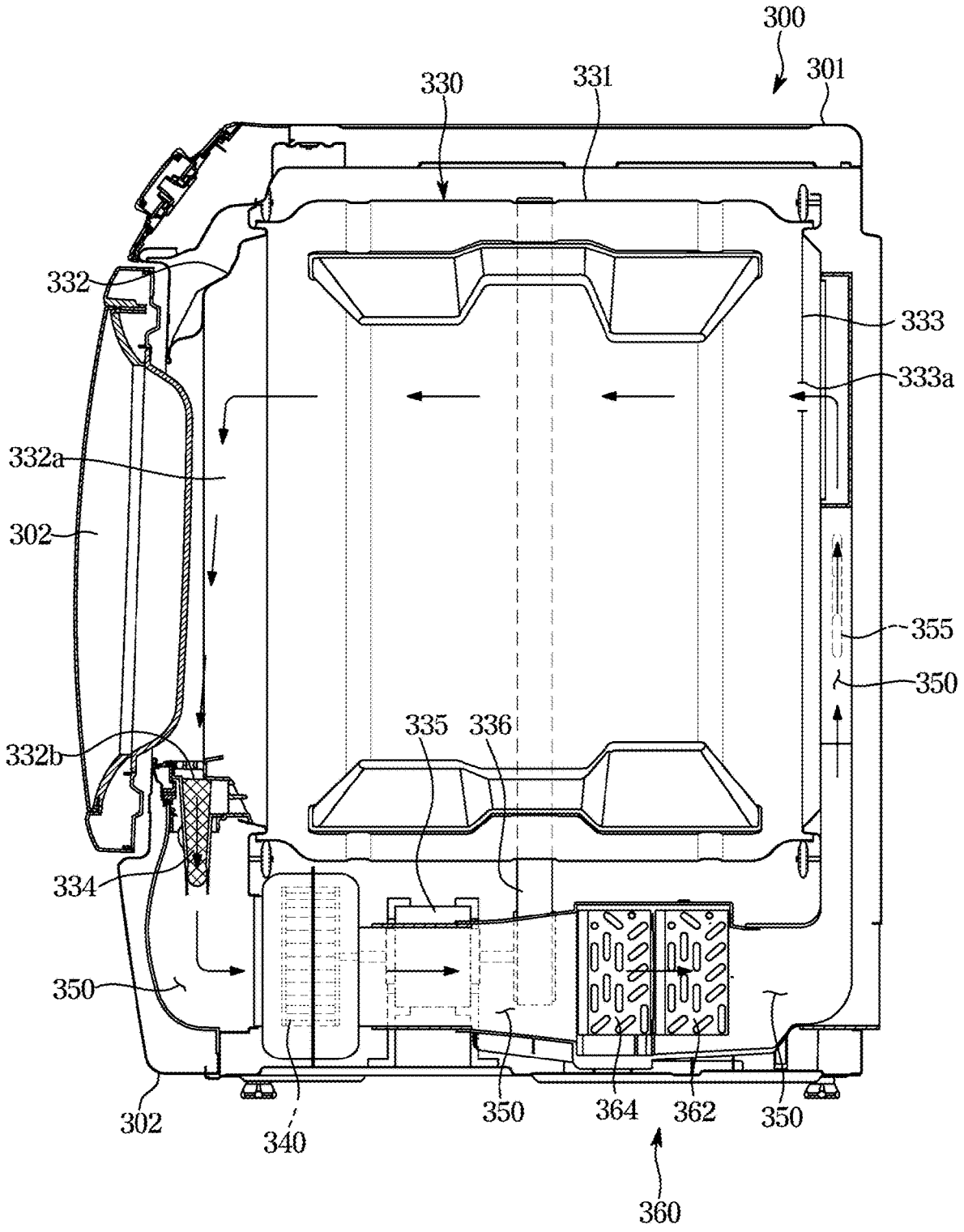
FIG. 11 is a view illustrating a side cross-section of a drying machine according to an embodiment.
Figure 12:
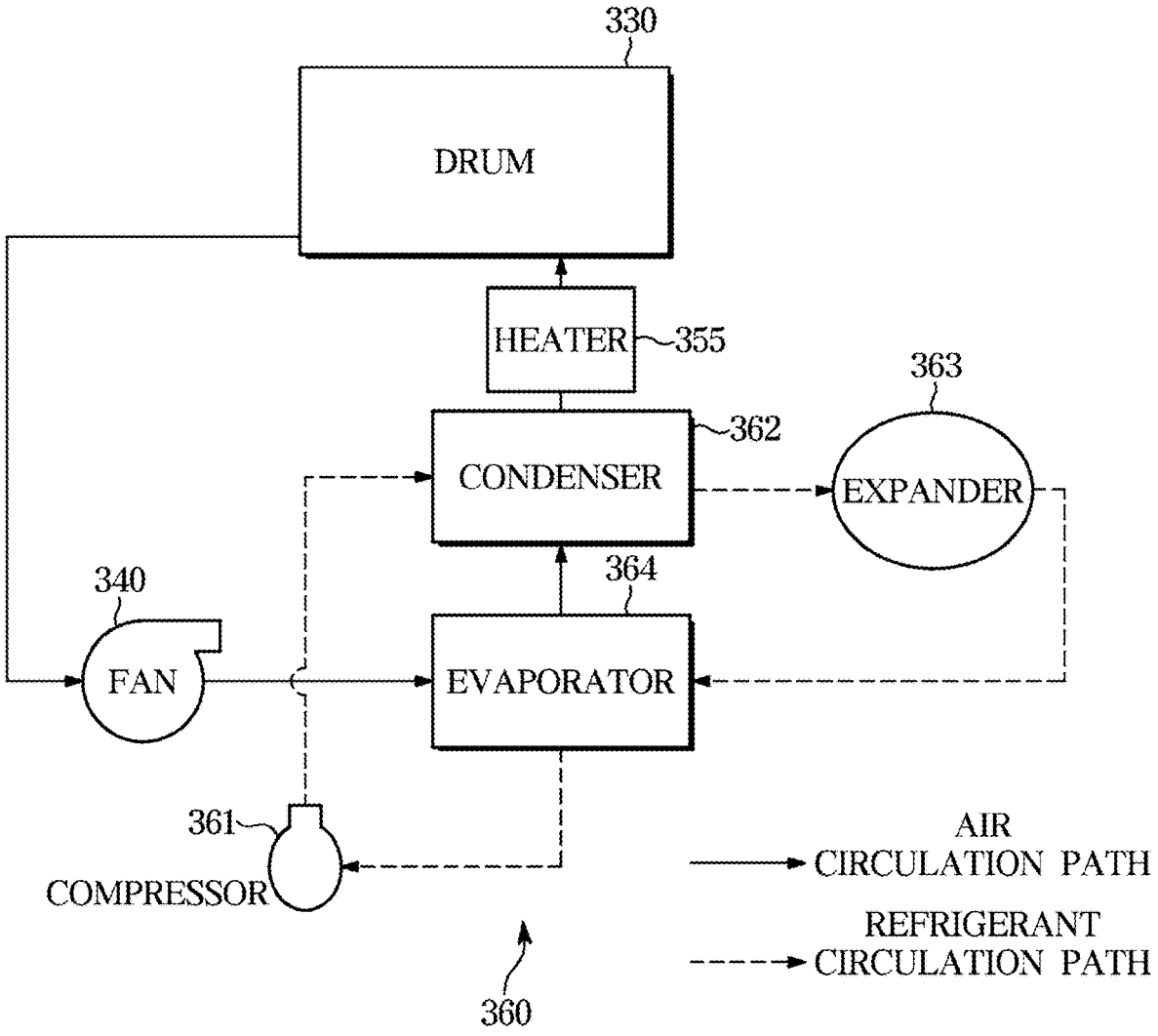
FIG. 12 is a view illustrating circulation of air and circulation of refrigerant in a drying machine according to an embodiment.

FIG. 11 is a view illustrating a side cross-section of a drying machine according to an embodiment. FIG. 12 is a view illustrating circulation of air and circulation of refrigerant in a drying machine according to an embodiment.

A configuration of the drying machine 300 will be described with reference to FIGS. 11 and 12 together with FIGS. 1 and 2 described above.

The drying machine 300 may include a cabinet 301. Further, the drying machine 300 may further include a door 302, a control panel 310, a drum 330, a drum motor 335, a fan 340, a fan motor 345, a duct 350, a heater 355, and a heat pump 360 accommodated in the cabinet 301.

At the center of a front surface of the cabinet 301, an inlet 301*a* may be formed to which laundry is put into or taken out of.

The door 302 may open and close the inlet 301*a*. The closing of the inlet 301*a* by the door 302 may be detected by a door switch 303. When the inlet 301*a* is closed and the drying machine 300 is operated, the door 302 may be locked by a door lock 304.

The control panel 310 including a display configured to display operation information of the drying machine 300 and a user inputter configured to obtain a user input for the drying machine 300 from the user may be provided on a front upper side of the cabinet 301. The control panel 310 is described in more detail below.

The drying machine 300 may include the drum 330 configured to accommodate the object to be dried and dry the object to be dried. The drum 330 may be rotatably installed in the cabinet 301.

The drum 330 may include a drum body 331 formed in a cylindrical shape whose center of rotation is formed in a front-rear, horizontal direction. A front panel 332 having an opening 332*a* formed therein to allow the object to be dried to be put into the drum 330 may be disposed at a front surface of the drum body 331. Also, a rear surface of the drum body 331 may be closed by a rear panel 333 having an inlet 333*a* formed therein to allow introduction of high-temperature dry hot air.

An outlet 332*b* through which air used in drying the object to be dried is discharged may be provided in the front panel 332 of the drum 330. A filter 334 configured to collect foreign substances removed from the object to be dried may be installed in the outlet 332*b*. Accordingly, the foreign substances removed from the object to be dried may be collected by the filter 334.

The drum 330 may receive a rotary force from the drum motor 335 and rotate. The drum 330 may be connected to the drum motor 335 disposed in the cabinet 301 by a belt 336. The drum motor 335 may provide the rotary force to the drum 330 through the belt 336.

One or more heat sources may be provided in the drying machine 300, and the drying machine 300 may supply high-temperature air to the drum 330 through the heat sources. For example, the drying machine 300 may include, as the heat sources, the heater 355 and the heat pump 360. In this case, drying machines including a heat pump forming a refrigerant circuit may be classified into circulating-type drying machines and air discharge-type drying machines according to the flow of air being circulated. The circulating-type drying machine may refer to a drying machine capable of drying an object by circulating air without discharging or sucking air. The air discharge-type drying machine may refer to a drying machine which sucks outside air, uses the outside air in drying, and then discharges the outside air to the outside of the drying machine.

The drying machine 300 may include the fan 340 configured to circulate air inside the drum 330. The fan 340 may suck air from inside the drum 330 and discharge the air to the duct 350. By the fan 340, the air inside the drum 330 may circulate through the drum 330 and the duct 350. The fan 340 may rotate by the fan motor 345.

The heater 355 and the heat pump 360 may be provided in the duct 350 through which the air inside the drum 330 circulates.

As illustrated in FIG. 12, the heat pump 360 may include a compressor 361, a condenser 362, an evaporator 364, and an expander 363. The compressor 361, the condenser 362, the expander 363, and the evaporator 364 may be seated at a bottom surface of the cabinet 301.

The compressor 361 may compress refrigerant in a gaseous state to a high-temperature, high-pressure state and discharge the gaseous refrigerant in the high-temperature, high-pressure state. The discharged refrigerant may be transferred to the condenser 362.

The condenser 362 may condense the compressed gaseous refrigerant to a liquid. The condenser 362 may dissipate heat to surrounding portions thereof through the process of condensing the refrigerant. The condenser 362 may be provided in the duct 350 and heat the air through heat generated in the process of condensing the refrigerant. The liquid refrigerant condensed by the condenser 362 may be transferred to the expander 363.

The expander 363 may expand the high-temperature, high-pressure liquid refrigerant condensed by the condenser 362 to the liquid refrigerant in a low-pressure state. For example, the expander 363 may include an expansion valve configured to adjust a pressure difference of the refrigerant.

The evaporator 364 may evaporate the liquid refrigerant expanded by the expander 363. As a result, the evaporator 364 may cause the low-temperature, low-pressure gaseous refrigerant to return to the compressor 361.

The evaporator 364 may absorb heat from the surrounding portions thereof through an evaporation process in which the low-pressure liquid refrigerant is changed to the gaseous refrigerant. The evaporator 364 may be provided in the duct 350 and may cool air passing through the evaporator 364 in the evaporation process.

Air around the evaporator 364 may be cooled by the evaporator 364, and, when a temperature of the air around the evaporator 364 becomes lower than the dew point, the air around the evaporator 364 may be condensed. Due to the condensation occurring around the evaporator 364, the absolute humidity of the air passing through the evaporator 364 may be lowered. In other words, the amount of water vapor contained in the air passing through the evaporator 364 may be reduced.

Using the condensation occurring around the evaporator 364, the drying machine 300 may reduce the amount of water vapor contained in the air inside the drum 330 and dry the object to be dried.

The evaporator 364 may be disposed more upstream than the condenser 362 on the basis of the flow of air due to the fan 340. The air circulating due to the fan 340 may be dried (water vapor may be condensed) by the evaporator 364 while the air passes through the evaporator 364, and then the air may be heated by the condenser 362 while passing through the condenser 362.

The heater 355 may assist the condenser 362 in heating the air. For example, before the condenser 362 of the heat pump 360 sufficiently heats the air in the duct 350, the heater 355 may assist the condenser 362 in heating the air in the duct 350.

The temperature inside the drum 330 may more rapidly rise due to the heater 355 assisting the condenser 362, and the drying machine 300 may more rapidly dry the object to be dried.

The heater 355 may be disposed more downstream than the condenser 362 on the basis of the flow of air due to the fan 340. The heater 355 may be implemented through a heating coil. However, the heater 355 is not limited thereto and may be implemented through various other known devices.

Figure 13:
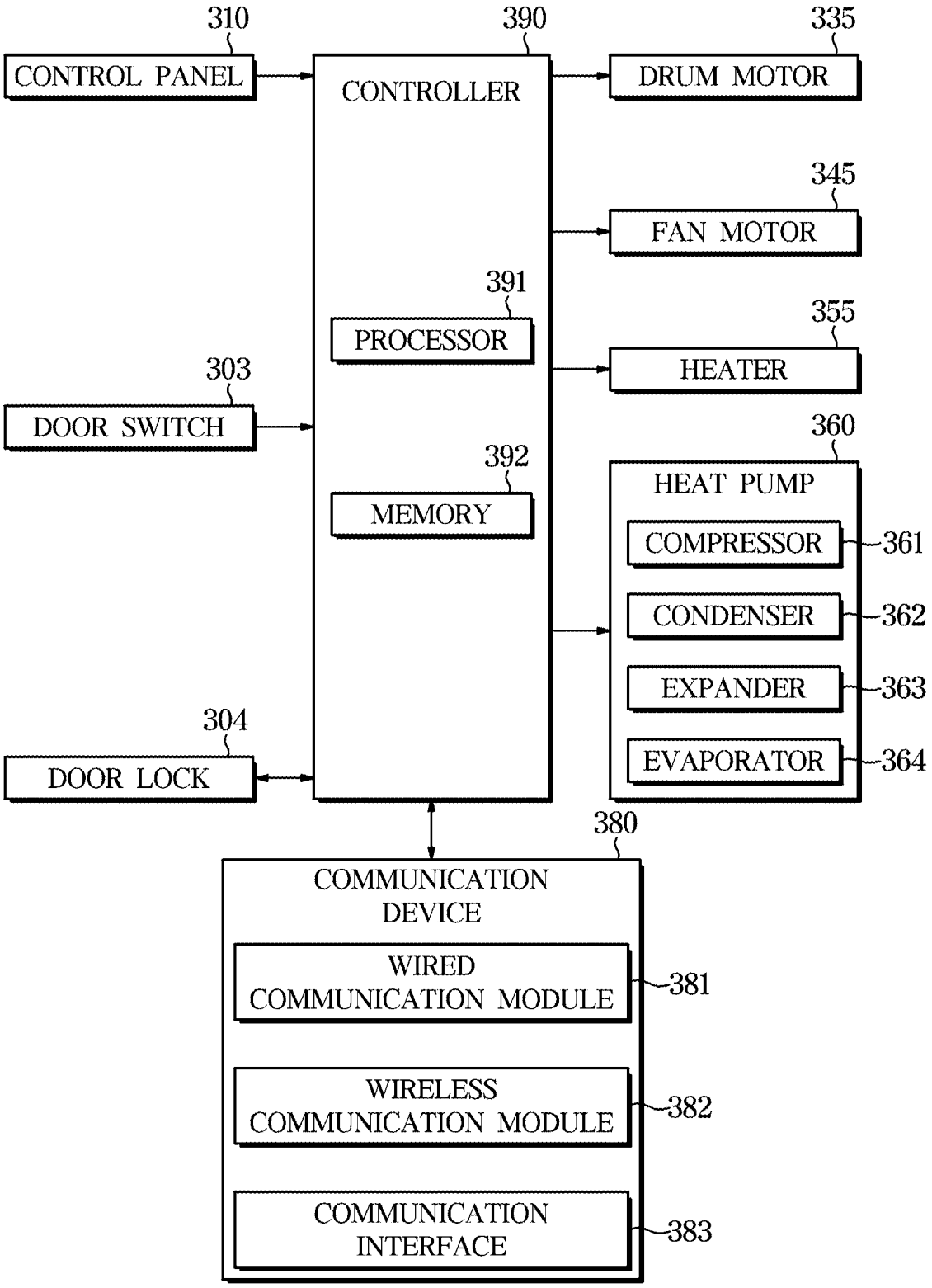
FIG. 13 is a view illustrating a configuration of a drying machine according to an embodiment.
Figure 14:
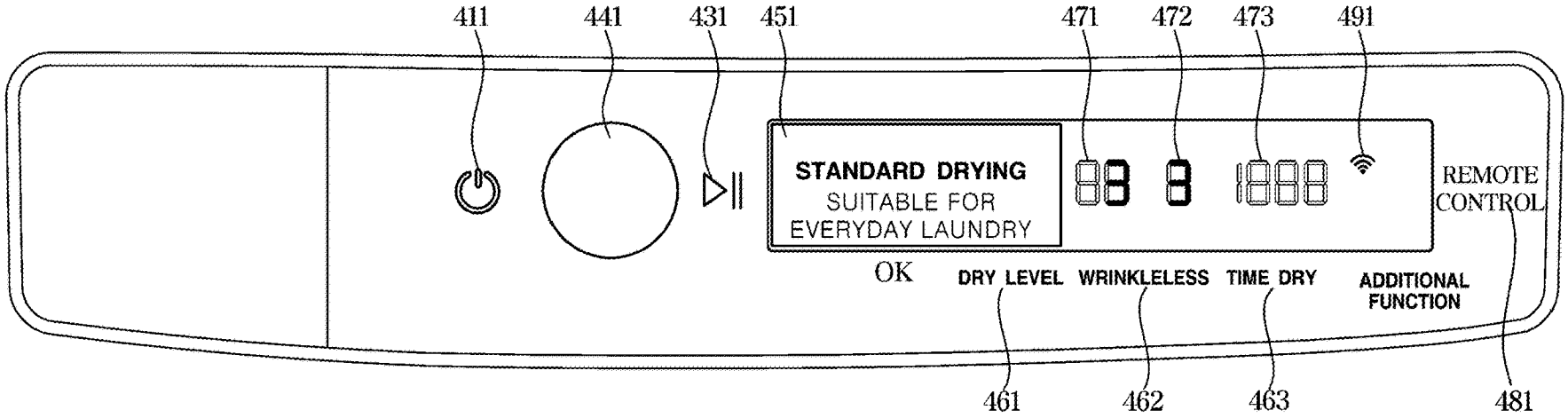
FIG. 14 is a view illustrating a control panel included in a drying machine according to an embodiment.

FIG. 13 is a view illustrating a configuration of a drying machine according to an embodiment. FIG. 14 is a view illustrating a control panel included in a drying machine according to an embodiment.

The drying machine 300 may further include the following electrical configurations as well as the mechanical configurations described in conjunction with FIGS. 11 and 12. The drying machine 300 may include the drum motor 335, the fan motor 345, the heater 355, the compressor 361, the door switch 303, the door lock 304, the control panel 310, a communication device 380, and a controller 390.

The drum motor 335 may rotate the drum 330 in response to a driving signal from the controller 390. The fan motor 345 may rotate the fan 340 in response to the driving signal of the controller 390. The heater 355 may heat air in the duct 350 in response to a heating signal from the controller 390. The compressor 361 may circulate the refrigerant of the heat pump 360 in response to the driving signal of the controller 390.

The door switch 303 may detect a state in which the door 302 is closed and a state in which the door 302 is open, respectively. The door lock 304 may lock the door 302 in response to a lock signal from the controller 390. When the door 302 closes the inlet 301*a* and the drying machine 300 operates, the controller 390 may control the door lock 304 to lock the door 302.

The control panel 310 may include the user inputter for obtaining the user input, and the display for displaying the washing setting and/or the washing operation information in response to the user input. In other words, the control panel 310 may provide an interface (hereinafter referred to as 'user interface') for the user and the drying machine 300 to interact.

The control panel 310 may include a dryer power button 411 for obtaining the user input for powering on the drying machine 300 or obtaining the user input for powering off the drying machine 300, as illustrated in FIG. 14. In addition, the dryer power button 411 may display a power status of the drying machine 300.

In relation to the power source, the drying machine 300 may be placed in three states including an "off state," a "standby state," and an "on state." The operation of the drying machine 300 in each of the "off state," the "standby state" and the "on state" may be the same as the washing machine 100.

The dryer power button 411 may include a tact switch, a push switch, a slide switch, a toggle switch, a micro switch, or a touch switch. For example, the dryer power button 411 may include the touch switch.

The control panel 310 may further include a drying operation button 431 that obtains the user input for starting the drying operation of the drying machine 300 or pausing the drying operation, as illustrated in FIG. 14. In addition, the drying operation button 431 may indicate whether the drying machine 300 is operating. The drying operation button 431 may be the same as the drying operation button 231 of the washing machine 100 (see FIG. 5).

The control panel 310 may further include a course selection dial 441 for obtaining the user input for selecting the drying course, and a course display 451 for displaying the drying course selected by the rotation of the course selection dial 241, as illustrated in FIG. 14. The course selection dial 441 and the course display 451 may be the same as the course selection dial 241 (see FIG. 5) and the course display 251 (see FIG. 5) of the washing machine 100 in the dryer control mode.

The control panel 310 may include a first setting button 461, a first setting display 471, a second setting button 462, a second setting display 472, a third setting button 463, and a third setting display 473, as illustrated in FIG. 14. The first, second, and third setting buttons 461, 462, and 463 may be the same as the first, second, and third setting buttons 261, 262, and 263 (see FIG. 5) of the washing machine 100 in the dryer control mode. The first, second, and third setting displays 471, 472, and 473 may be the same as the first, second, and third setting displays 271, 272, and 273 (see FIG. 5) of the washing machine 100 in the dryer control mode.

The control panel 310 may include a remote control button 481 for obtaining the user input for activating or deactivating the remote control of the drying machine 300 by the external device, such as the user device, as illustrated in FIG. 14, and an additional setting display 491 for displaying whether the remote control of the drying machine 300 is activated. The remote control button 481 and the additional setting display 491 may be the same as the remote control button 281 (see FIG. 5) and the additional setting display 291 (see FIG. 5) of the washing machine 100 in the dryer control mode.

The communication device 380 may transmit data to the washing machine 100 and receive data from the washing machine 100.

The communication device 380 may include a wired communication module 381 that exchanges data with the washing machine 100 by wire, a wireless communication module 382 that exchanges data with the washing machine 100 wirelessly, and a communication device 383 that is a passage for exchanging data with the washing machine 100.

The wired communication module 381, the wireless communication module 382, and the communication interface 383 may be the same as the wired communication module 181 (see FIG. 4), the wireless communication module 182 (see FIG. 4), and the communication interface 183 (see FIG. 4) of the washing machine 100.

The controller 390 may be mounted on a printed circuit board provided on the rear side of the control panel 310, for example.

The controller 390 may be electrically connected to the drum motor 335, the fan motor 345, the heater 355, the compressor 361, the door switch 303, the door lock 304, the control panel 310, and the communication device 380.

The controller 390 may include a processor 391 for generating a control signal for controlling the operation of the drying machine 300, and a memory 392 for memorizing or storing a program and data for generating a control signal for controlling the operation of the drying machine 300. The processor 391 and the memory 392 may be implemented as separate chips or as a single chip. In addition, the controller 390 may include a plurality of processors or a plurality of memories.

The processor 391 may process data and/or signals according to a program provided from the memory 392 and provide control signals to each configuration of the drying machine 300 based on the processing results.

The processor 391 may receive the user input from the control panel 310 and process the user input.

The processor 391 may control the control panel 310 to display the drying setting and the drying operation information in response to the user input.

The processor 391 may control the drum motor 335, the fan motor 345, the heater 355, the compressor 361, and the door lock 304 to perform the drying operation in response to the user input.

In addition, the processor 391, the drum motor 335, the fan motor 345, the heater 355, the compressor 361, and the door lock 304 may perform the drying operation depending on the drying settings received through the communication device 380.

The processor 391 may include an operation circuit, a memory circuit, and a control circuit. The processor 391 may include one chip or may include a plurality of chips. In addition, the processor 391 may include one core or may include a plurality of cores.

The memory 392 may memorize/store data including a program for controlling the washing operation according to the drying course, and data including the drying settings according to the drying course and the drying settings according to the drying course. Also, the memory 392 may memorize/store the currently selected drying course and drying setting based on the user input.

The memory 392 may include a volatile memory such as S-RAM and D-RAM, and a non-volatile memory such as ROM and EPROM. The memory 392 may include one memory element or a plurality of memory elements.

As described above, the drying machine 300 may not only perform the drying operation for drying the object to be dried based on the user input obtained through the control panel 310, but also perform the drying operation for drying the object to be dried based on the drying setting received through the communication device 380.

Hereinafter, the operations of the washing machine 100 and the drying machine 300 will be described. The operation of the washing machine 100 may be performed under the control of the controller 190 and/or the processor 191, and the operation of the drying machine 300 may be performed under the control of the controller 390 and/or the processor 391.

Figure 15A:
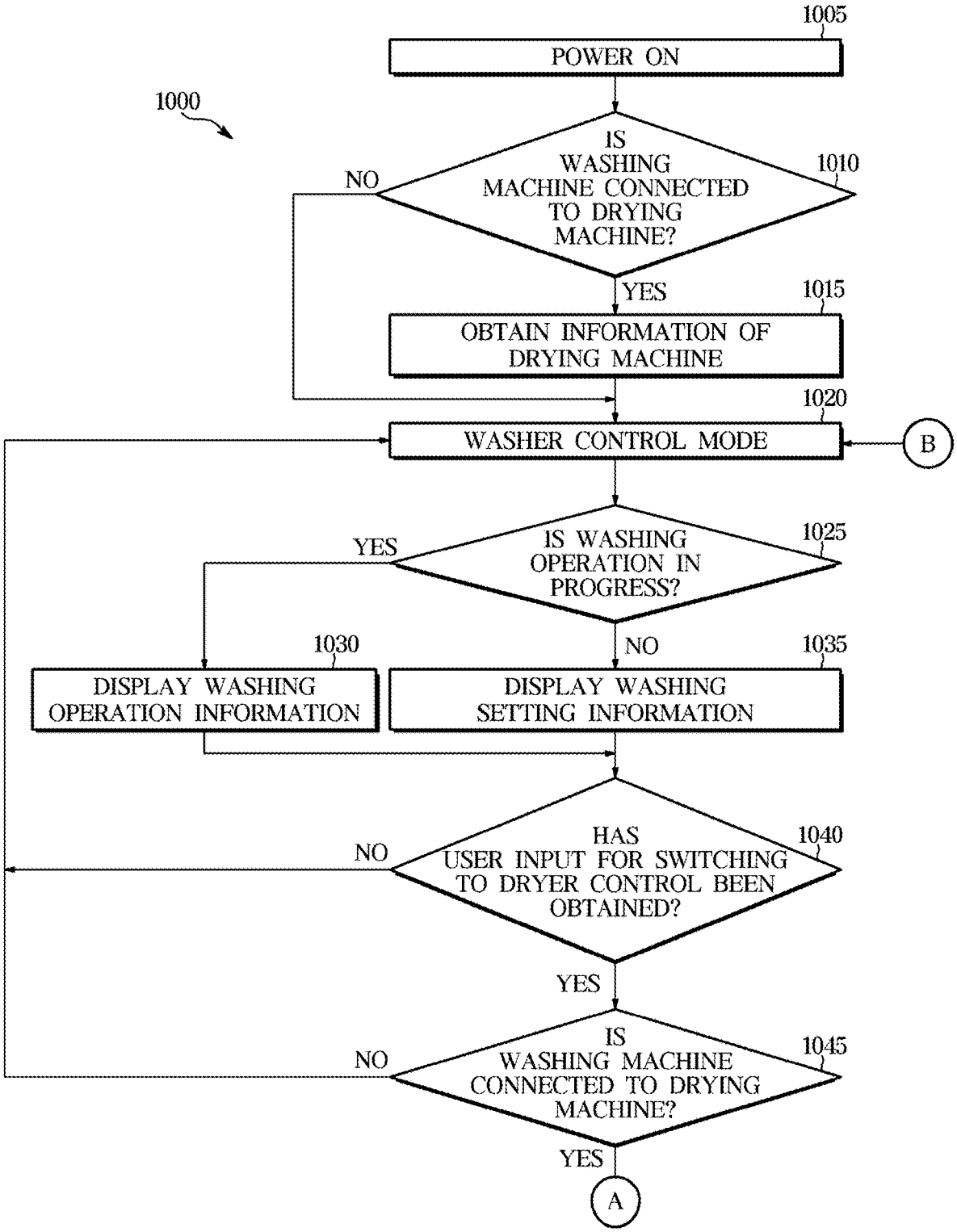
FIGS. 15*a* and 15*b* illustrate a mode switching method of a washing machine according to an embodiment.
Figure 15B:
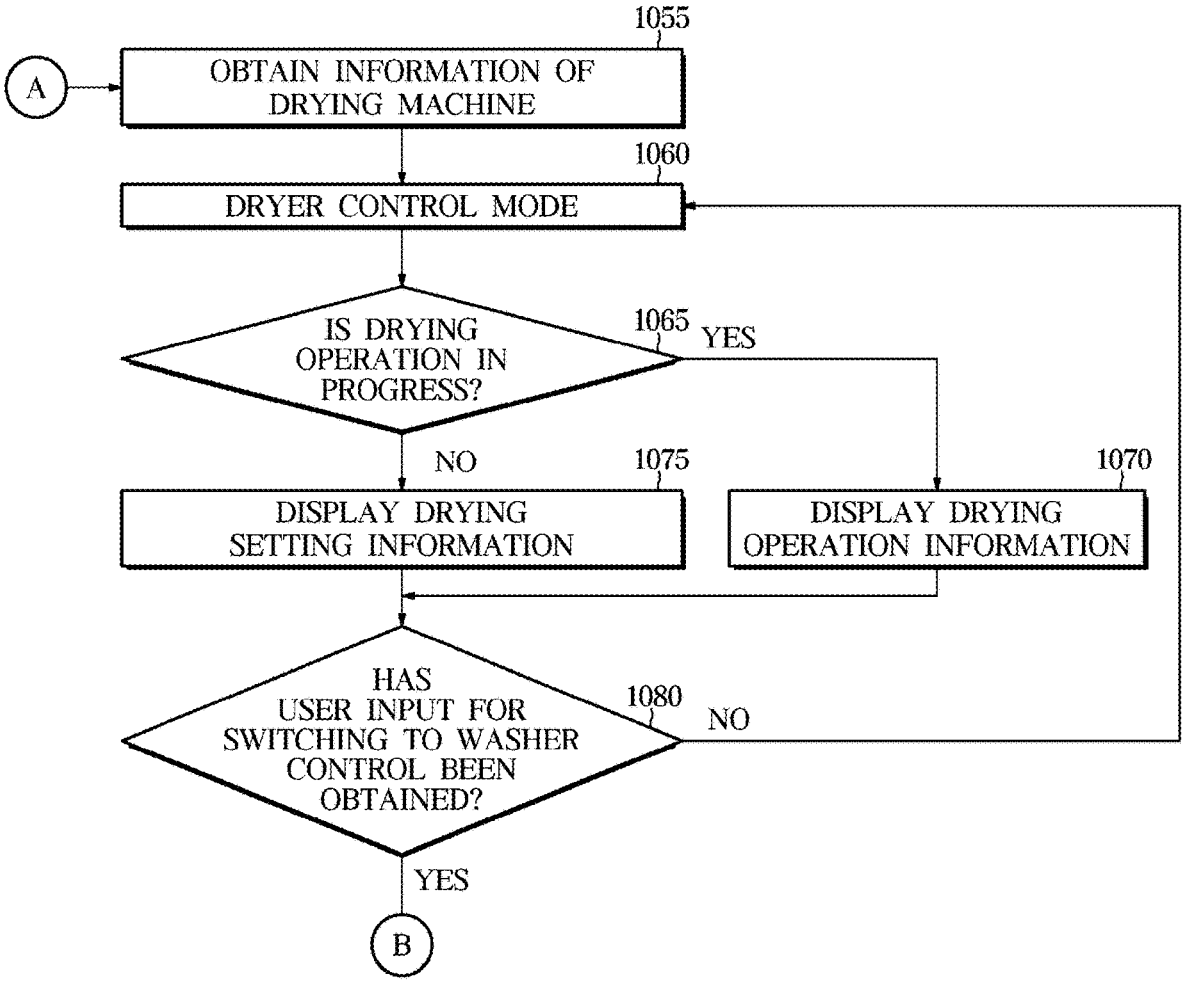

FIGS. 15*a* and 15*b* illustrate a mode switching method of a washing machine according to an embodiment.

Referring to FIGS. 15*a* and 15*b*, a mode switching method 1000 of the washing machine 100 is described.

The washing machine 100 may be turned on (1005).

The washing machine 100 may be placed in the "standby state" in which the plug is inserted into the power socket and the user's power-on command is not input.

When the washer power button 211 of the control panel 110 is touched or pressed by the user, the washing machine 100 may be switched from the "standby state" to the 'on state.' In the 'standby state,' the power may be supplied to the controller 190 and the control panel 110. The power may be supplied to the first touch switch 211*a* of the washer power button 211. The first touch switch 211*a* may detect a user touch for powering on the washing machine 100 and provide the electrical signal according to the detection of the user touch to the controller 190. The controller 190 may supply power to all of the components included in the washing machine 100 in response to the user touch for power on. In other words, the washing machine 100 may be switched from the "standby state" to the "on state," and in the "on state," the power may be supplied to all of the components included in the washing machine 100.

The washing machine 100 may determine whether the washing machine 100 is connected to the drying machine 300 (1010).

The controller 190 may identify whether it is possible to communicate with the drying machine 300 through the communication device 180.

For example, the controller 190 may identify whether the communication line 181*a* or the wireless dongle 182*a* is inserted into the communication interface 183. When the communication line 181*a* or the wireless dongle 182*a* is not inserted into the communication interface 183, the controller 190 may identify that it is not connected to the drying machine 300.

When the communication line 181*a* or the wireless dongle 182*a* is inserted into the communication interface 183, the controller 190 may transmit a request message and identify whether a response message has been received in response to the request message. When the response message is not received, the controller 190 may identify that it is not connected to the drying machine 300.

When the response message is received, the controller 190 may identify whether the drying machine 300 can communicate by wire or wirelessly with the drying machine 300.

Upon identifying that the controller 190 can communicate with the drying machine 300, the controller 190 may identify whether the communication line 181*a* has been inserted into the communication interface 183 or the wireless dongle 182*a* has been inserted. In other words, the controller 190 may identify whether the drying machine 300 can communicate by wire or wirelessly with the drying machine 300.

When the washing machine 100 determines that the washing machine 100 is connected to the drying machine 300 (YES in 1010), the washing machine 100 may obtain information of the drying machine 300 from the drying machine 300 (1015).

When it is identified that communication with the drying machine 300 is possible, the controller 190 may request the drying operation information and/or the drying setting information of the drying machine 300 through the communication device 180, and receive the drying operation information and/or the drying setting information of the drying machine 300 through the communication device 180. For example, the controller 190 may determine whether the drying machine 300 is in the "on state," and when it is in the "on state," the controller 190 may determine whether the drying machine 300 is in the drying operation. When the drying machine 300 is in the drying operation, the controller 190 may receive the time remaining until the drying operation is completed through the communication device 180.

Based on the information received from the drying machine 300, the controller 190 may determine whether the drying machine 300 is in the "on state," and when it is in the "on state," the controller 190 may determine whether the drying machine 300 is in the drying operation. When the drying machine 300 is in the drying operation, the controller 190 may identify the time remaining until the drying operation is completed.

As such, the washing machine 100 may identify whether the washing machine 100 is connected to the drying machine 300 after being powered on, and receive the operation information and/or the setting information of the drying machine 300 from the drying machine 300.

However, the disclosure is not limited thereto, and the washing machine 100 may supply power to the communication device 180 at a predetermined cycle during the 'standby state,' identify whether the washing machine 100 is connected to the drying machine 300 through the communication device 180, and receive the operation information and/or the setting information of the drying machine 300 from the drying machine 300. In addition, the washing machine 100 may identify whether the washing machine 100 is connected to the drying machine 300 through the communication device 180 at the predetermined cycle even during the "on state" and receive the operation information and/or the setting information of the drying machine 300 from the drying machine 300.

After determining that the drying machine 300 is not connected (NO in 1010) or receiving information of the drying machine 300, the washing machine 100 may operate in the washer control mode (1020).

Regardless of whether the communication of the drying machine 300 is possible, the washing machine 100 may operate in the washer control mode after being turned on. In other words, the washer control mode may be a default setting of the operating mode of the washing machine 100.

After the washing machine 100 is turned on, until the user input for switching the operation mode is obtained, the controller 190 may operate in the washer control mode. In the washer control mode, the controller 190 may display information of the washing machine 100 and obtain the user input to the washing machine 100. Particularly, in the washer control mode, the controller 190 may display the washing operation information and/or washing setting information and obtain the user input for controlling the washing operation and/or the washing setting.

The controller 190 may control the control panel 110 so that the washer control button 222 emits light. The controller 190 may control the control panel 110 to display the washing course on the course display 251. In addition, the controller 190 may control the control panel 110 to display the 'washing temperature,' 'number of rinsing times,' and 'dehydrating strength' on the first setting button 261, the second setting button 262, and the third setting button 263, respectively. In other words, the controller 190 may control the control panel 110 to display information related to the operation of the washing machine 100 on the display, and obtain inputs related to the operation of the washing machine 100 through input buttons.

Thereafter, the washing machine 100 may determine whether the washing operation is in progress (1025).

The controller 190 may store data indicating that the washing is not performed in the memory 192 before the washing machine 100 starts the washing operation. In addition, the controller 190 may store data indicating the washing operation in the memory 192 in response to a washing start command through the washing operation button 232.

The controller 190 may identify whether the washing machine 100 is operating or whether the washing machine 100 is not operating based on data stored in the memory 192. For example, the controller 190 may identify that the washing machine 100 is operating based on data stored in the memory 192 during the washing operation. In addition, the controller 190 may identify that the washing machine 100 is not in operation, based on data indicating that the washing is not performed in the memory 192.

When the washing is in operation (YES in 1025), the washing machine 100 may display the washing operation information (1030), and when the washing is not in operation (NO in 1025), the washing machine 100 may display the washing setting information (1035).

When the washing machine 100 is in operation, the controller 190 may display information about the washing operation of the washing machine 100 on the control panel 110. For example, the controller 190 may display the time remaining until the end of the washing operation on the course display 251.

In addition, when the washing machine 100 is not in operation, the controller 190 may display information about the washing setting of the washing machine 100 on the control panel 110. For example, the controller 190 may display the washing course on the course display 251, the washing temperature on the first setting display 271, the number of rinsing times on the second setting display 272, and the dehydrating strength on the third setting display 273.

As such, the washing machine 100 may display information about the washing operation or information about the washing setting of the washing machine 100 on the control panel 110 during the washer control mode.

The washing machine 100 may determine whether the user input for switching to the dryer control mode is obtained during the washer control mode (1040).

The control panel 110 may be provided with the dryer control button 221 for obtaining the user input to activate the dryer control for controlling the drying machine 300. In order to switch the operation mode of the washing machine 100 to the dryer control mode that can control the drying machine 300 using the control panel 110 of the washing machine 100, the user may touch or press the dryer control button 221.

When the dryer control button 221 is touched or pressed, the controller 190 may determine that the user input for activating the dryer control is obtained.

When the user input for switching to the dryer control mode is not obtained (NO in 1040), the washing machine 100 may maintain the washer control mode. In addition, the washing machine 100 may display the washing operation information and/or the washing setting information and obtain the user input for controlling the washing operation and/or the washing setting.

When the user input for switching to the dryer control mode is obtained (YES in 1040), the washing machine 100 may determine whether the washing machine 100 is connected to the drying machine 300 (1045).

In response to the dryer control button 221 being touched, the controller 190 may determine whether it is possible to communicate with the drying machine 300 through the communication device 180. In other words, the controller 190 may identify whether it is possible to switch to the dryer control mode.

Operation 1045 may be the same as operation 1010.

When it is determined that the washing machine 100 is not connected to the drying machine 300 (NO in 1045), the washing machine 100 may maintain the washer control mode.

When the washing machine 100 determines that the washing machine 100 is connected to the drying machine 300 (YES in 1045), the washing machine 100 may obtain information of the drying machine 300 from the drying machine 300 (1055).

Operation 1055 may be the same as operation 1015.

As described above, when the washing machine 100 obtains the user input for switching to the dryer control mode, the washing machine 100 may identify whether the washing machine 100 is connected to the drying machine 300 and receive the operation information and/or the setting information of the drying machine 300 from the drying machine 300.

However, the disclosure is not limited thereto, and the washing machine 100 may identify whether the washing machine 100 is connected to the drying machine 300 through the communication device 180 at the predetermined cycle and receive the operation information and/or the setting information of the drying machine 300 from the drying machine 300.

Thereafter, the washing machine 100 may operate in the dryer control mode (1060).

In response to the dryer control button 221 being touched, the controller 190 may display the drying operation information and/or the drying setting information of the drying machine 300 and operate in the dryer control mode for obtaining the user input to the drying machine 300.

The controller 190 may display information of the drying machine 300 received through the communication device 180 in the dryer control mode and obtain the user input to the drying machine 300. Particularly, in the dryer control mode, the controller 190 may display the drying operation information and/or the drying setting information and obtain the user input for controlling the drying operation and/or the drying setting.

The controller 190 may control the control panel 110 so that the dryer control button 221 emits light. The controller 190 may control the control panel 110 to display the drying course on the course display 251. In addition, the controller 190 may control the control panel 110 to display the 'degree of drying,' 'anti-wrinkle,' and 'time setting' on the first setting button 261, the second setting button 262, and the third setting button 263, respectively. In other words, the controller 190 may control the control panel 110 to display information related to the operation of the drying machine 300 on the display, and obtain inputs related to the operation of the drying machine 300 through input buttons.

The washing machine 100 may determine whether the drying machine 300 is in the drying operation (1065).

The controller 190 may identify whether the drying machine 300 is operating or not, based on the operation information of the drying machine 300 received from the drying machine 300. For example, the controller 190 may identify that the drying machine 300 is operating based on data received through the communication device 180 during the drying operation. In addition, the controller 190 may identify that the drying machine 300 is not operating based on data indicating that the drying is not performed through the communication device 180.

When the drying machine 300 is in the drying operation (YES in 1065), the washing machine 100 may display the drying operation information (1070), and when the drying machine 300 is not in the drying operation (NO in 1065), the washing machine 100 may display the drying setting information (1075).

When the drying machine 300 is in the drying operation, the controller 190 may display information about the drying operation of the drying machine 300 on the control panel 110. For example, the controller 190 may display the time remaining until the end of the drying operation on the course display 251.

In addition, when the drying machine 300 is not in operation, the controller 190 may display information about the drying setting of the drying machine 300 on the control panel 110. For example, the controller 190 may display the drying course on the course display 251, the degree of drying on the first setting display 271, the additional time for anti-wrinkle on the second setting display 272, and the drying time on the third setting display 273.

As such, the washing machine 100 may display information about the drying operation or information about the drying setting of the drying machine 300 on the control panel 110 during the dryer control mode.

The washing machine 100 may determine whether the user input for switching to the washer control mode is obtained during the dryer control mode (1080).

The control panel 110 may be provided with the washer control button 222 for obtaining the user input to activate the washer control for controlling the washing machine 100. In order to switch the operation mode of the washing machine 100 to the washer control mode that can control the washing machine 100 using the control panel 110 of the washing machine 100, the user may touch or press the washer control button 222.

When the washer control button 222 is touched or pressed, the controller 190 may determine that the user input for activating the washer control is obtained.

When the user input for switching to the washer control mode is not obtained (NO in 1080), the washing machine 100 may maintain the dryer control mode. In addition, the washing machine 100 may display the drying operation information and/or the drying setting information and obtain the user input for controlling the drying operation and/or the drying setting.

When the user input for switching to the washer control mode is obtained (YES in 1080), the washing machine 100 may operate in the washer control mode.

As described above, the washing machine 100, depending on the user input, may operate in the washer control mode for controlling the washing operation and/or the washing setting of the washing machine 100 or may operate in the dryer control mode for controlling the drying operation and/or the drying setting of the drying machine 300.

Thereby, the user may control the drying operation of the drying machine 300 and input the drying settings using the control panel 110 of the washing machine 100. For example, when the drying machine 300 is located on top of the washing machine 100, the user may control the drying machine 300 using the control panel 110 of the washing machine 100 without manipulating the control panel 310 of the drying machine 300.

Figure 16:
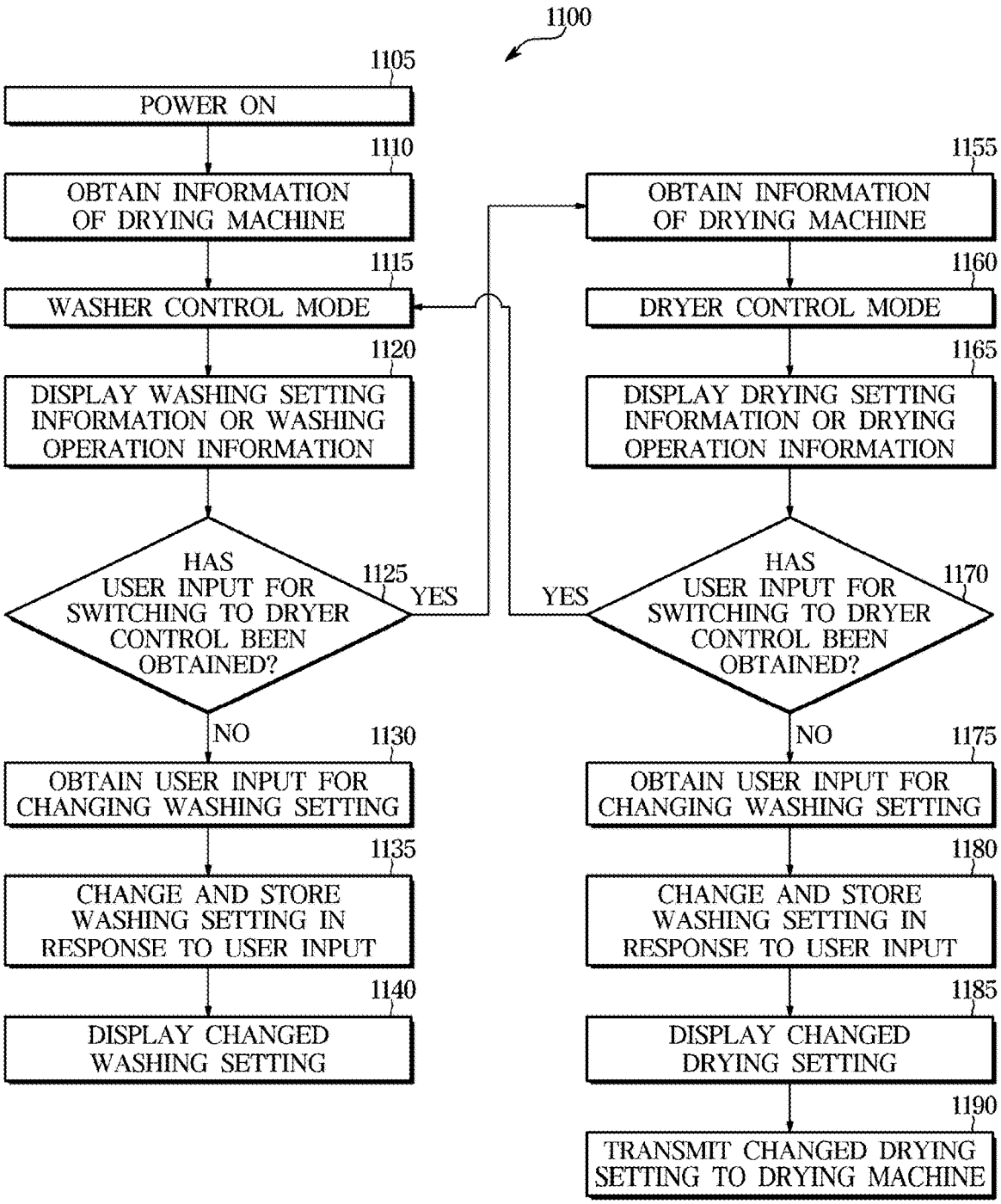
FIG. 16 is a view illustrating a washing/drying setting input method of a washing machine according to an embodiment.
Figure 17:
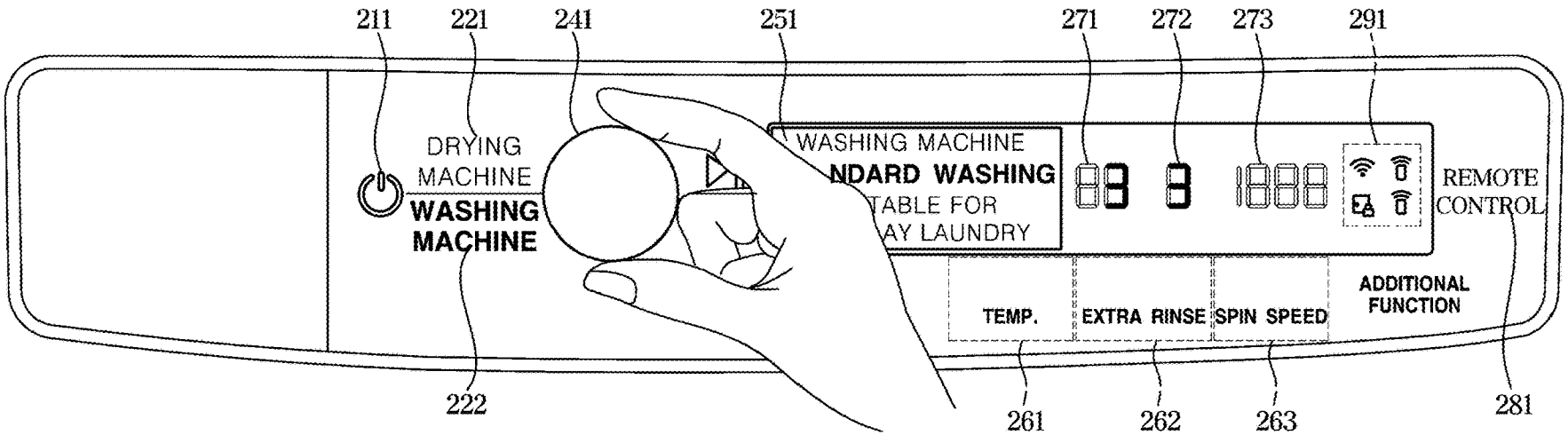
FIG. 17 is a view illustrating a washing setting input of a washing machine according to an embodiment.
Figure 18:
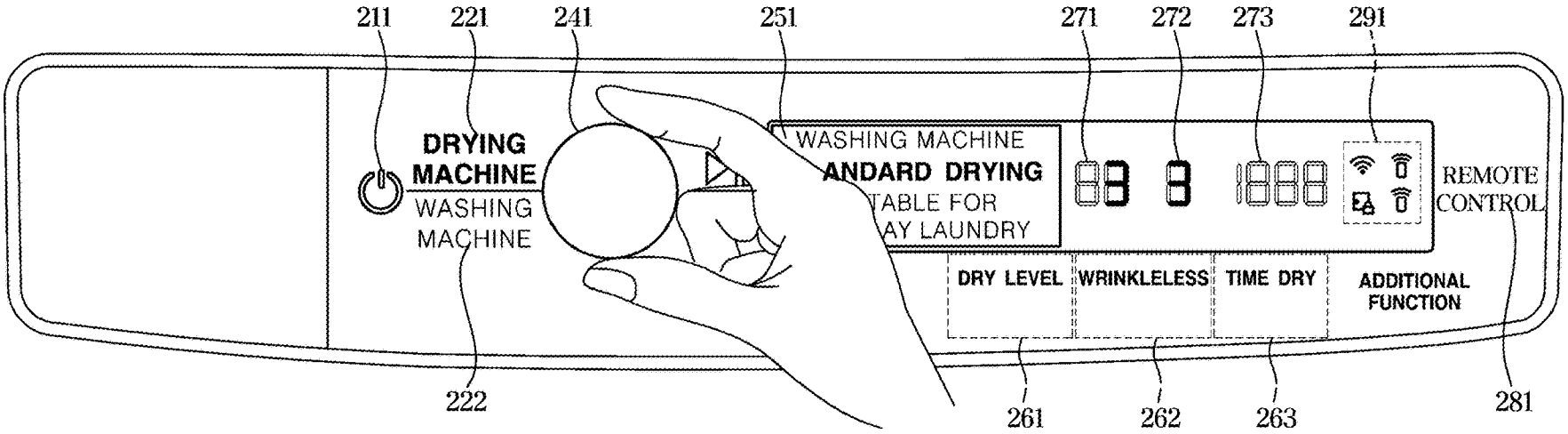
FIG. 18 is a view illustrating a drying setting input of a washing machine according to an embodiment.

FIG. 16 is a view illustrating a washing/drying setting input method of a washing machine according to an embodiment. FIG. 17 is a view illustrating a washing setting input of a washing machine according to an embodiment. FIG. 18 is a view illustrating a drying setting input of a washing machine according to an embodiment.

Referring to FIGS. 16, 17 and 18, a setting input method 1100 of the washing machine 100 is described.

The washing machine 100 may be turned on (1105).

Operation 1105 may be the same as operation 1005 illustrated in FIG. 15*a*.

The washing machine 100 may obtain information of the drying machine 300 from the drying machine 300 (1110).

The controller 190 may identify whether the washing machine 100 can communicate with the drying machine 300 through the communication device 180. When it is identified that the washing machine 100 is capable of communicating with the drying machine 300, the controller 190 may receive the drying operation information and/or the drying setting information of the drying machine 300 through the communication device 180.

As described above, the washing machine 100 first determines whether or not the washing machine 100 is connected to the drying machine 300. When it determines that the washing machine 100 is connected to the drying machine 300, the washing machine 100 may obtain information of the drying machine 300 from the drying machine 300. However, in the following, it is assumed that the washing machine 100 is connected to the drying machine 300.

Operation 1110 may be the same as operation 1010 and operation 1015 illustrated in FIG. 15*a*.

The washing machine 100 may operate in the washer control mode (1115).

The washing machine 100 may operate in the washer control mode, regardless of whether the communication of the drying machine 300 is possible after being turned on.

Operation 1115 may be the same as operation 1020 illustrated in FIG. 15*a*.

The washing machine 100 may display the washing setting information or the washing operation information (1120).

The controller 190 may determine whether the washing machine 100 is in the washing operation based on data stored in the memory 192, for example. The controller 190 may display information about the washing operation of the washing machine 100 on the control panel 110 when the washing machine 100 is in the washing operation. When the washing machine 100 is not in operation, the controller 190 may display information about the washing setting of the washing machine 100 on the control panel 110.

As such, the washing machine 100 may display information about the washing operation or information about the washing setting of the washing machine 100 on the control panel 110 during the washer control mode.

Operation 1115 may be the same as operation 1025, operation 1030, and operation 1035 illustrated in FIG. 15*a*.

The washing machine 100 may determine whether the user input for switching to the dryer control mode is obtained during the washer control mode (1125).

When the dryer control button 221 provided on the control panel 110 is touched or pressed, the controller 190 may determine that the user input for activating the dryer control is obtained.

Operation 1125 may be the same as operation 1040 illustrated in FIG. 15*a*.

When it is determined that the washing machine 100 does not obtain the user input for switching to the dryer control mode (NO in 1125), the washing machine 100 may obtain the user input for changing the washing setting in the washer control mode (1130).

The control panel 110 may be provided with the course selection dial 241 for obtaining the user input for selecting the washing course and the first, second, and third setting buttons 261, 262, and 263 for obtaining the user input for selecting the washing setting (e.g., washing temperature, number of rinsing times, dehydrating strength, etc.) in the washer control mode. The user may operate the course selection dial 241, the first, second, and third setting buttons 261, 262, and 263 to input the washing course and the washing settings of the washing machine 100 in the washer control mode.

For example, as illustrated in FIG. 17, the course selection dial 241 may be rotated by the user. The controller 190 may identify the user input for selecting the washing course in response to the rotation of the course selection dial 241. Also, the controller 190 may identify the user input for changing the washing setting in response to at least one of the first, second, and third setting buttons 261, 262, and 263 being touched or pressed.

The washing machine 100 may change and store the washing settings in response to obtaining the user input (1135).

The controller 190 may display the plurality of washing courses in order on the course display 251 while the course selection dial 241 rotates. In addition, the controller 190 may select the washing course displayed on the course display 251 as a course for washing laundry when the rotation of the course selection dial 241 is stopped.

The controller 190 may change the washing temperature for washing the laundry in response to the first setting button 261 being touched or pressed, the number of rinsing times for rinsing the laundry in response to the second setting button 262 being touched or pressed, and the dehydrating strength for dehydrating the laundry in response to the third setting button 263 being touched or pressed.

The controller 190 may memorize or store the selected washing course and the changed washing settings in the memory 192.

The washing machine 100 may display the changed washing settings in response to the user input (1140).

The controller 190 may display the selected washing course on the course display 251 by the rotation of the course selection dial 241 being stopped. In addition, the controller 190 may display the changed washing temperature, the changed number of rinsing times, and the changed dehydrating strength on the first, second, and third setting displays 271, 272, and 273.

As described above, the washing machine 100 may obtain the washing setting for controlling the washing operation through the control panel 110 during the washer control mode, and display the change of the washing setting on the control panel 110.

Returning to operation 1125, upon obtaining the user input for switching to the dryer control mode (YES in 1125), the washing machine 100 may obtain information of the drying machine 300 from the drying machine 300 (1155).

The controller 190 may identify whether the washing machine 100 can communicate with the drying machine 300 through the communication device 180 in response to the user input for switching to the dryer control mode. When it is identified that the washing machine 100 is capable of communicating with the drying machine 300, the controller 190 may receive the drying operation information and/or the drying setting information of the drying machine 300 through the communication device 180.

Operation 1155 may be the same as operation 1010 and operation 1015 illustrated in FIG. 15*a*.

The washing machine 100 may operate in the dryer control mode (1160).

In response to the dryer control button 221 being touched, the washing machine 100 may operate in the dryer control mode.

Operation 1160 may be the same as operation 1060 illustrated in FIG. 15*b*.

The washing machine 100 may display the drying setting information or the drying operation information (1165).

The controller 190 may determine, for example, whether the drying machine 300 is in the washing operation based on data received from the drying machine 300. The controller 190 may display the information about the drying operation of the drying machine 300 when the drying machine 300 is in the drying operation, and the control panel 110. The controller 190 may display the information about the drying setting of the drying machine 300 on the control panel 110 when the drying machine 300 is not in operation.

As such, the washing machine 100 may display information about the drying operation of the drying machine 300 or information about the drying setting on the control panel 110 during the dryer control mode.

Operation 1165 may be the same as operation 1065, operation 1070, and operation 1075 illustrated in FIG. 15*b*.

The washing machine 100 may determine whether the user input for switching to the washer control mode is obtained during the dryer control mode (1170).

When the washer control button 222 provided on the control panel 110 is touched or pressed, the controller 190 may determine that the user input for activating the washer control is obtained.

Operation 1170 may be the same as operation 1080 illustrated in FIG. 15*b*.

When the user input for switching to the washer control mode is obtained (YES in 1170), the washing machine 100 may operate in the washer control mode (1115).

When it is determined that the washing machine 100 does not obtain the user input for switching to the washer control mode (NO in 1170), the washing machine 100 may obtain the user input for changing the washing setting in the dryer control mode (1175).

The control panel 110 may be provided with the course selection dial 241 for obtaining the user input for selecting the drying course and the first, second, and third setting buttons 261, 262, and 263 for obtaining the user input for selecting the drying setting (e.g., degree of drying, additional time for anti-wrinkle, drying time, etc.) in the dryer control mode. The user may operate the course selection dial 241, the first, second, and third setting buttons 261, 262, and 263 to input the drying course and the drying settings of the drying machine 300 in the washer control mode.

For example, as illustrated in FIG. 18, the course selection dial 241 may be rotated by the user. The controller 190 may identify the user input for selecting the drying course in response to the rotation of the course selection dial 241. Also, the controller 190 may identify the user input for changing the drying setting in response to at least one of the first, second, and third setting buttons 261, 262, and 263 being touched or pressed.

The washing machine 100 may change and store the drying settings in response to obtaining the user input (1135).

The controller 190 may display the plurality of washing courses in order on the course display 251 while the course selection dial 241 rotates. In addition, the controller 190 may select the drying course displayed on the course display 251 as a course for drying the object to be dried when the rotation of the course selection dial 241 is stopped.

The controller 190 may change the degree of drying for drying the object to be dried in response to the first setting button 261 being touched or pressed, the additional time for the anti-wrinkle of the object to be dried in response to the second setting button 262 being touched or pressed, and the drying time at which the drying machine 300 operates in response to the third setting button 263 being touched or pressed.

The controller 190 may memorize or store the selected drying course and the changed drying settings in the memory 192 (1180).

The washing machine 100 may display the changed drying settings in response to the user input (1185).

The controller 190 may display the selected drying course on the course display 251 by the rotation of the course selection dial 241 being stopped. In addition, the controller 190 may display the changed degree of drying, the changed additional time for the anti-wrinkle, and the drying time on the first, second, and third setting displays 271, 272, and 273.

The washing machine 100 may transmit the drying settings to the drying machine 300 (1190).

The controller 190 may control the communication device 180 to transmit information about the changed drying course and the drying settings to the drying machine 300 in response to the user input.

The controller 190 may control the communication device 180 to transmit information about the drying course and/or the drying settings to the drying machine 300 whenever the user input for changing the drying course and/or the drying settings is obtained, or may control the communication device 180 to transmit information about the drying course and/or the drying setting stored in the memory 192 at a predetermined time to the drying machine 300.

The controller 390 of the drying machine 300 may receive the drying course and the drying settings through the communication device 380. The controller 390 of the drying machine 300 may store the drying course and the drying settings received from the washing machine 100 in the memory 392, and display the drying course and the drying settings received from the washing machine 100 to the control panel 310.

As such, the washing machine 100 may obtain the drying setting for controlling the drying operation through the control panel 110 during the dryer control mode, and display the change of the drying setting on the control panel 110. In addition, the washing machine 100 may transmit information about the drying settings to the drying machine 300.

As described above, the washing machine 100 may obtain the user input for controlling the washing operation in the washer control mode and obtain the user input for controlling the drying operation in the dryer control mode.

Thereby, the user may input the user input for controlling the drying operation of the drying machine 300 and changing the drying setting using the control panel 110 of the washing machine 100. In other words, the user may be provided with the first user interface for controlling the washing machine and the second user interface for controlling the drying machine through one of the control panels 110.

Figure 19:
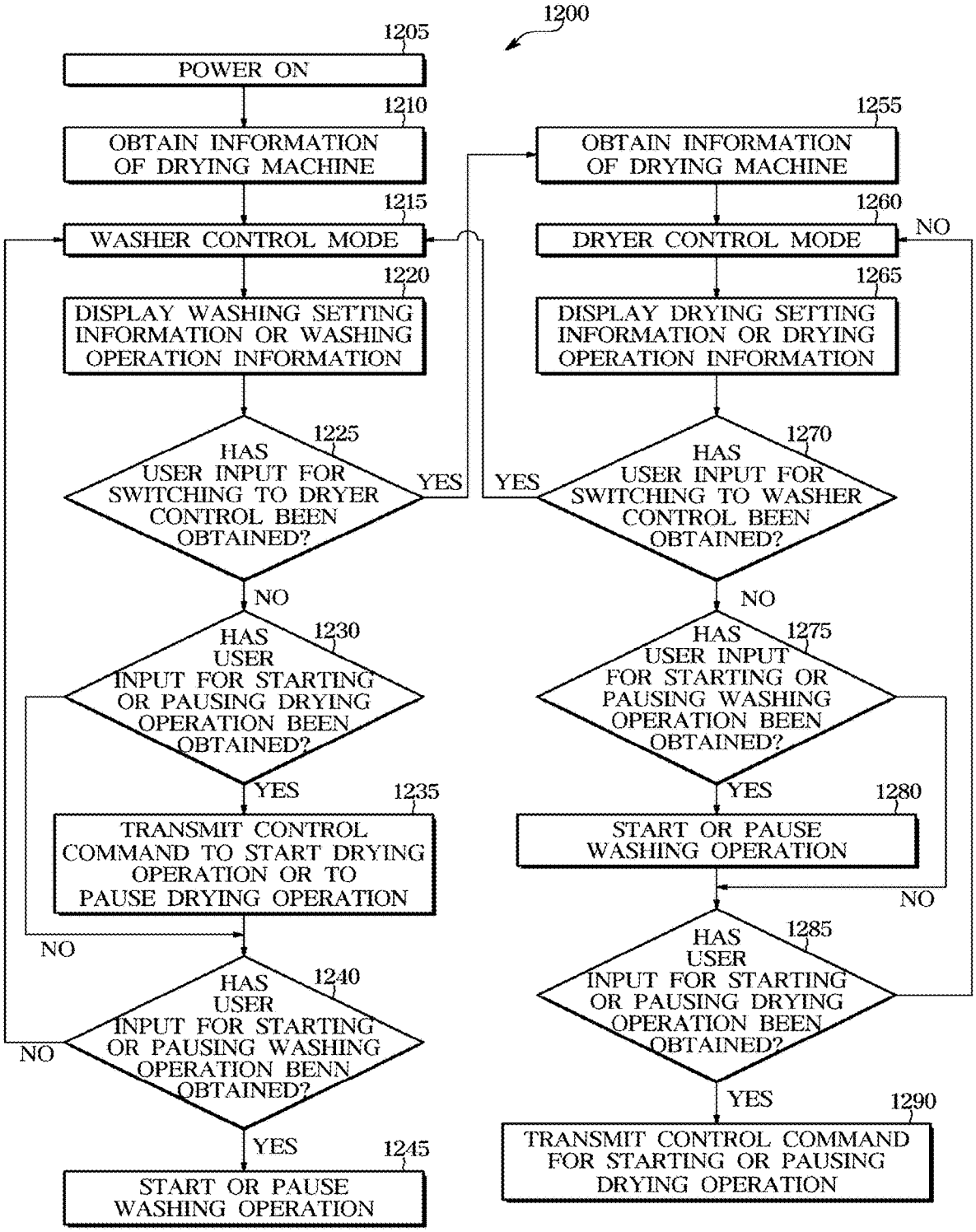
FIG. 19 is a view illustrating a washing/drying operation start method of a washing machine according to an embodiment.
Figure 20:
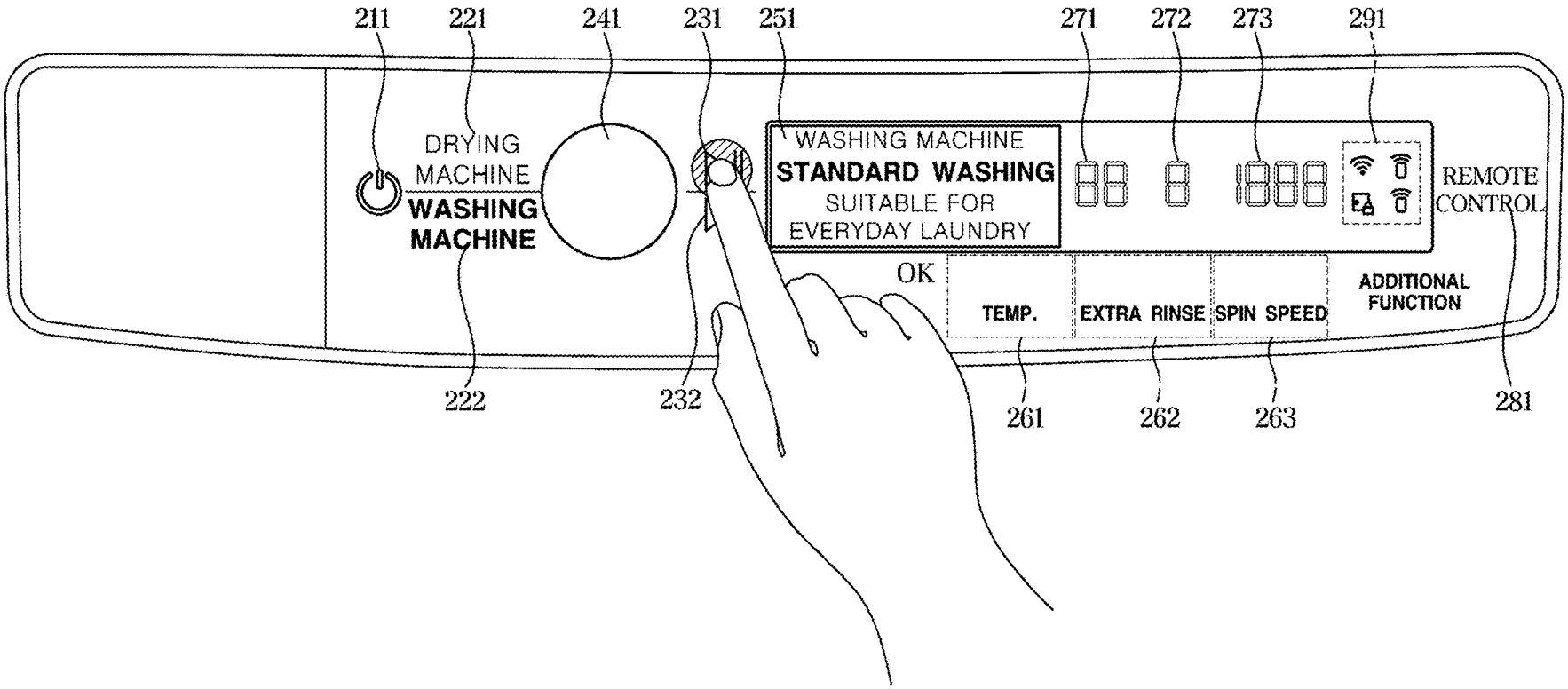
FIG. 20 is a view illustrating a washing start input of a washing machine according to an embodiment.
Figure 21:
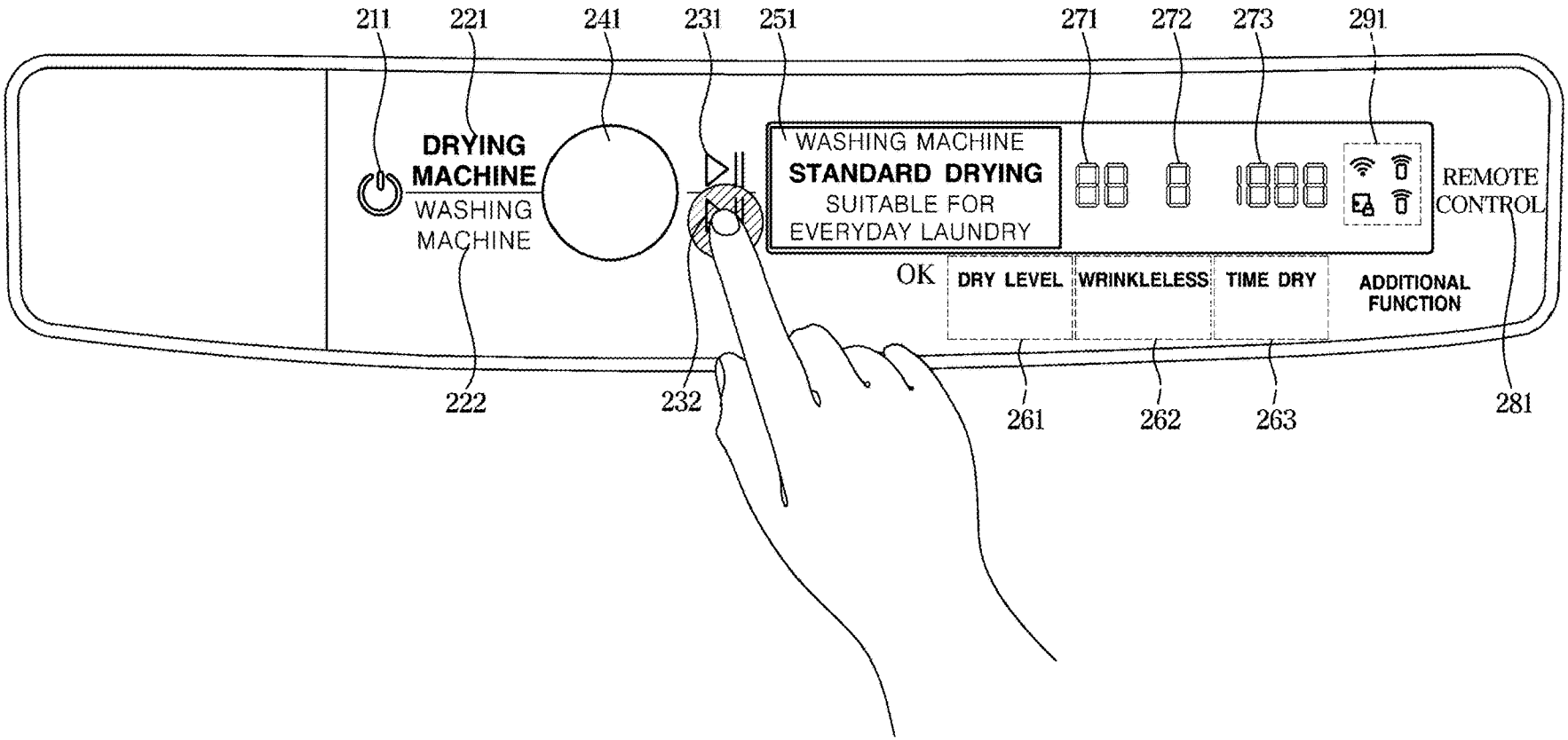
FIG. 21 is a view illustrating a drying start input of a washing machine according to an embodiment.

FIG. 19 is a view illustrating a washing/drying operation start method of a washing machine according to an embodiment. FIG. 20 is a view illustrating a washing start input of a washing machine according to an embodiment. FIG. 21 is a view illustrating a drying start input of a washing machine according to an embodiment.

Referring to FIGS. 19, 20 and 21, an operation start method 1200 of the washing machine 100 is described.

The washing machine 100 may be turned on (1205), obtain information of the drying machine 300 from the drying machine 300 (1210), operate in the washer control mode (1215), display the washing setting information or the washing operation information, and determine whether the user input for switching to the dryer control mode is obtained (1225).

Operation 1205, operation 1210, operation 1215, operation 1220, and operation 1225 may be the same as operation 1105, operation 1110, operation 1115, operation 1120, and operation 1125 illustrated in FIG. 16.

When it is determined that the washing machine 100 does not obtain the user input for switching to the dryer control mode (NO in 1225), the washing machine 100 may determine whether the user input for starting or pausing the drying operation in the washer control mode is obtained. (1230).

The control panel 110 may be provided with the drying operation button 231 for obtaining the user input to start the drying operation or to pause the drying operation of the drying machine 300.

For example, as illustrated in FIG. 20, during the washer control mode, the user may input the user input for the drying machine 300 to dry the object to be dried according to the drying course and the drying settings through the drying operation button 231 while operation information of the washing machine is displayed on the display 251. In addition, the user may input the user input for the drying machine 300 to pause the drying operation, through the drying operation button 231 during the drying operation.

The controller 190 may obtain the user input for starting the drying operation or the user input for pausing the drying operation from the user through the drying operation button 231, regardless of the control mode of the washing machine 100. In other words, the controller 190 may obtain the user input for starting the drying operation or the user input for pausing the drying operation through the drying operation button 231 in the dryer control mode, as well as the user input for starting the drying operation or the user input for pausing the drying operation through the drying operation button 231 in the washer control mode while operation information of the washing machine is displayed on the display 251.

When the washing machine 100 determines that it has obtained the user input for starting or pausing drying (YES in 1230), the washing machine 100 may transmit a control command to the drying machine 300 to start the drying operation or to pause the drying operation (1235).

In response to the drying operation button 231 being touched or depressed, the controller 190 may control the communication device 180 so that the drying machine 300 transmits the control command for starting the drying operation to the drying machine 300. In addition, the controller 190 may control the communication device 180 to transmit the control command for starting the drying operation to the drying machine 300, along with information about the drying course and/or the drying settings.

The controller 190 may determine whether to transmit the control command for starting the drying operation to the drying machine 300, depending on whether the wired or wireless communication with the drying machine 300 is performed. For example, when communicating with the washing machine 100 and the drying machine 300 by wire, the controller 190 may transmit the control command for starting the drying operation to the drying machine 300.

On the other hand, when the washing machine 100 communicates wirelessly with the drying machine 300, the controller 190 may not transmit the control command for starting the drying operation to the drying machine 300. When the washing machine 100 communicates wirelessly with the drying machine 300, the washing machine 100 may be located away from the drying machine 300. Therefore, the user of the washing machine 100 may operate the drying machine 300 without checking the drying machine 300. For example, even if a pet or the like is contained inside the drying machine 300, the user may operate the drying machine 300 without checking it. To prevent this, when the washing machine 100 communicates wirelessly with the drying machine 300, it may be prevented (or prohibited) that the controller 190 of the washing machine 100 transmits the drying operation command for rotating the drum 330 of the drying machine 300 to the drying machine 300.

As such, the controller 190 may preferably control the wired communication module 181 so that the drying machine 300 transmits the control command for starting the drying operation to the drying machine 300.

The controller 390 of the drying machine 300 may receive the control command for starting the drying operation through the communication device 380. In response to the control command for starting the drying operation, the controller 390 may control the components included in the drying machine 300 to perform the drying operation. The controller 390 may identify whether the door 302 is closed depending on an output signal of the door switch 303. When it is identified that the door 302 is closed, the controller 390 may control the door lock 304 to lock the door 302. When it is identified that the door 302 is locked, the controller 390 may control the drum motor 335 to rotate the drum 330, control the fan motor 345 to rotate the fan 340, and control the heater 355 to heat the inside of the duct 350.

In addition, in response to the drying operation button 231 being touched or pressed during the drying operation of the drying machine 300, the controller 190 of the washing machine 100 may control the communication device 180 so that the drying machine 300 transmits the control command for pausing the drying operation to the drying machine 300.

The controller 390 of the drying machine 300 may receive the control command to pause the drying operation through the communication device 380. In response to the control command for pausing the drying operation, the controller 390 may control the components included in the drying machine 300 to stop the drying operation. For example, the controller 390 may control the drum motor 335 to stop the drum 330, control the fan motor 345 to stop the fan 340, and stop the heater 355 to stop heating of the duct 350.

When it is determined that the washing machine 100 does not obtain the user input for starting or pausing drying (NO in 1230), the washing machine 100 determines whether the user input for starting or pausing the washing operation may be obtained (1240).

The control panel 110 may be provided with the washing operation button 232 for starting the washing operation of the washing machine 100 or obtaining the user input for pausing the washing operation.

For example, as illustrated in FIG. 21, during the washer control mode, the user may input the user input for the washing machine 100 to wash the laundry according to the washing course and the washing settings through the washing operation button 232. In addition, the user may input the user input for the washing machine 100 to pause the washing operation, through the washing operation button 232 during the washing operation.

The controller 190 may obtain the user input for starting the washing operation or the user input for pausing the washing operation from the user through the washing operation button 232, regardless of the control mode of the washing machine 100. In other words, the controller 190 may obtain the user input for starting the washing operation or the user input for pausing the washing operation through the washing operation button 232 in the washer control mode, as well as the user input for starting the washing operation or the user input for pausing the washing operation through the washing operation button 232 in the dryer control mode while operation information of the drying machine is displayed on the display 251.

When the washing machine 100 determines that it has obtained the user input for starting or pausing washing (YES in 1240), the washing machine 100 may transmit a control command to the washing machine 100 to start the washing operation or to pause the washing operation (1245).

In response to the washing operation button 232 being touched or depressed, the controller 190 may control the components included in the washing machine 100 to perform the washing operation. The controller 190 may identify whether the door 102 is closed depending on the output signal of the door switch 103. When it is identified that the door 102 is closed, the controller 190 may control the door lock 104 to lock the door 102. When it is identified that the door 302 is locked, the controller 190 may control the water supply valve 152 to supply water to the tub 120, and may control the drum motor 140 to rotate the drum 130 at a low speed for washing/rinsing. In addition, the controller 190 may control the drain pump 162 to discharge the water contained in the tub 120, and may control the drum motor 140 to rotate the drum 130 at a high speed for dehydration.

In addition, the controller 190 may control the components included in the washing machine 100 to pause the washing operation in response to the washing operation button 232 being touched or pressed during the washing operation of the washing machine 100. For example, the controller 190 may control the water supply valve 152 to stop the water supply during the water supply, and may control the drum motor 140 to stop the rotation of the drum 130 during washing/rinsing. In addition, the controller 190 may control the drain pump 162 to stop draining during drainage, and may control the drum motor 140 to stop the rotation of the drum 130 during dehydration.

Returning to operation 1225, upon obtaining the user input for switching to the dryer control mode (YES in 1225), the washing machine 100 may obtain information of the drying machine 300 from the drying machine 300 (1255). The washing machine 100 may operate in the dryer control mode (1260), display the drying setting information or the drying operation information (1265), and determine whether the user input for switching to the washer control mode is obtained (1270).

Operation 1255, operation 1260, operation 1265, and operation 1270 may be the same as operation 1155, operation 1160, operation 1165, and operation 1170 illustrated in FIG. 16.

When the user input for switching to the washer control mode is obtained (YES in 1270), the washing machine 100 may operate in the washer control mode (1215).

When it is determined that the washing machine 100 does not obtain the user input for switching to the washer control mode (NO in 1270), the washing machine 100 may determine whether the user input for starting or pausing the washing operation in the dryer control mode is obtained. (1275).

The controller 190 may obtain the user input for starting the washing operation from the user through the washing operation button 232, regardless of the control mode of the washing machine 100.

Operation 1275 may be the same as operation 1240.

When it is determined that the washing machine 100 obtains the user input for starting or pausing washing (YES in 1275), the washing machine 100 may start the washing operation or pause the washing operation (1280).

Operation 1280 may be the same as operation 1245.

When it is determined that the washing machine 100 does not obtain the user input for starting or pausing the washing (NO in 1280), the washing machine 100 may determine whether the user input for starting or pausing the drying operation is obtained (1285). The controller 190 may obtain the user input for initiating a washing operation from the user through the drying operation button 231, regardless of the control mode of the washing machine 100.

Operation 1285 may be the same as operation 1230.

When it is determined that the washing machine 100 has obtained the user input for starting or pausing drying (YES in 1285), the washing machine 100 may transmit the control command to the drying machine 300 to start the drying operation or to pause the drying operation. (1290).

Operation 1290 may be the same as operation 1235.

As described above, the washing machine 100 may obtain the user input for starting/pausing the washing operation and the user input for starting/pausing the drying operation, regardless of the control mode.

Thereby, the user may quickly stop the operation of the drying machine 300 in an urgent situation. For example, to stop the drying machine 300 during the drying operation, the user may pause the operation of the drying machine 300 by directly touching the drying operation button 231 without touching the dryer control button 221 for switching the control mode.

Figure 22A:
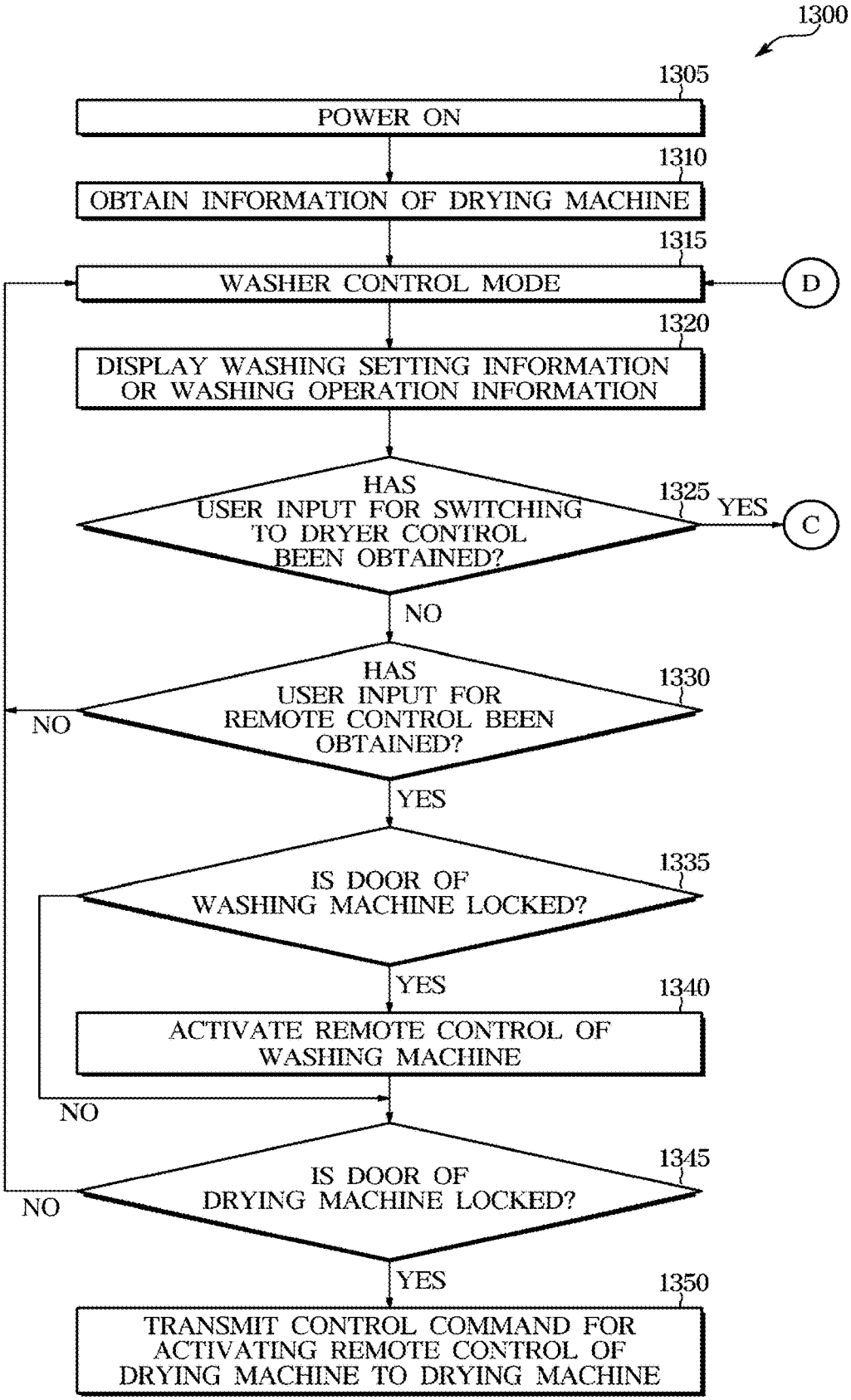
FIGS. 22*a* and 22*b* illustrate a remote control activation method of a washing machine and a drying machine according to an embodiment.
Figure 22B:
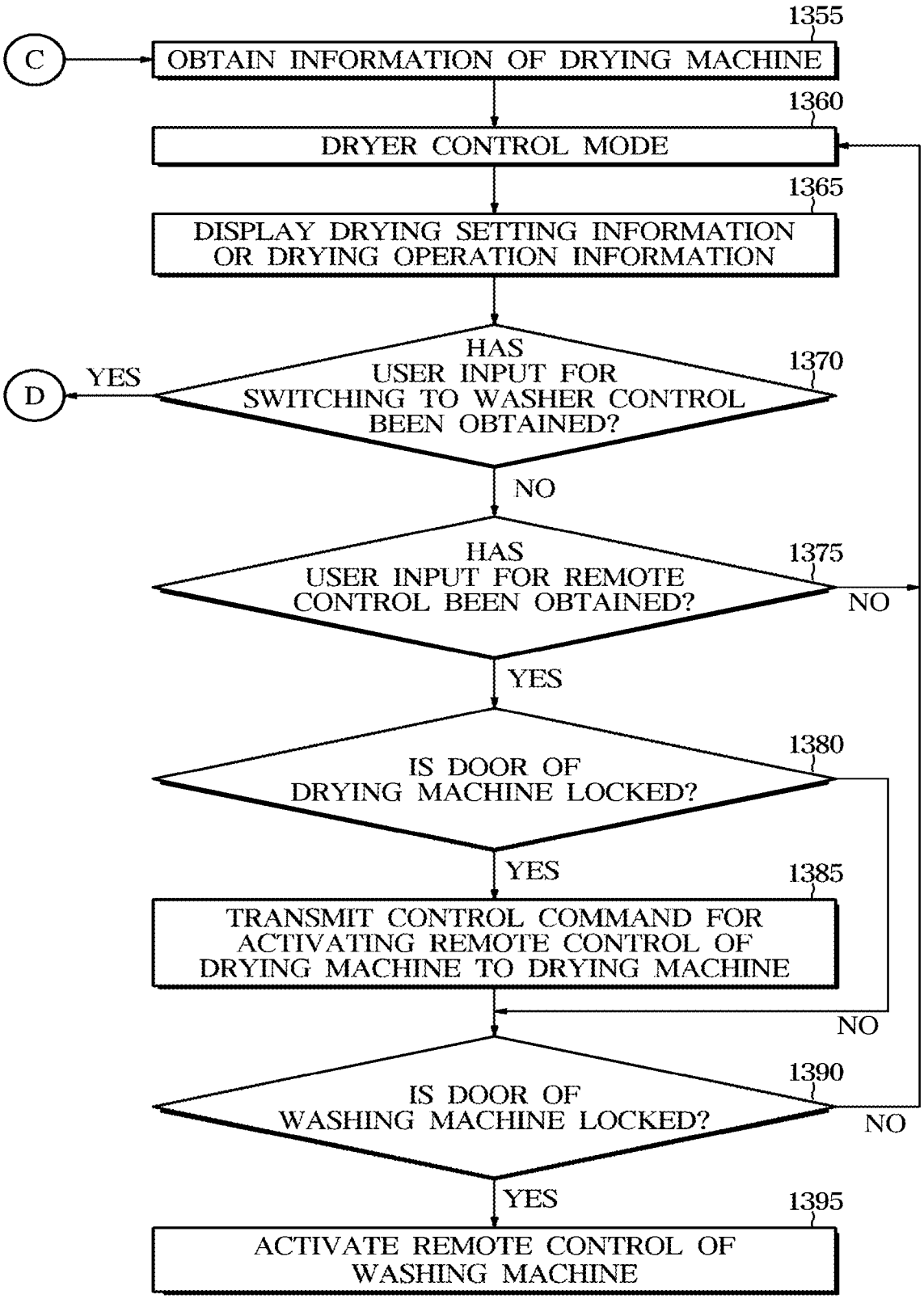
Figure 23:
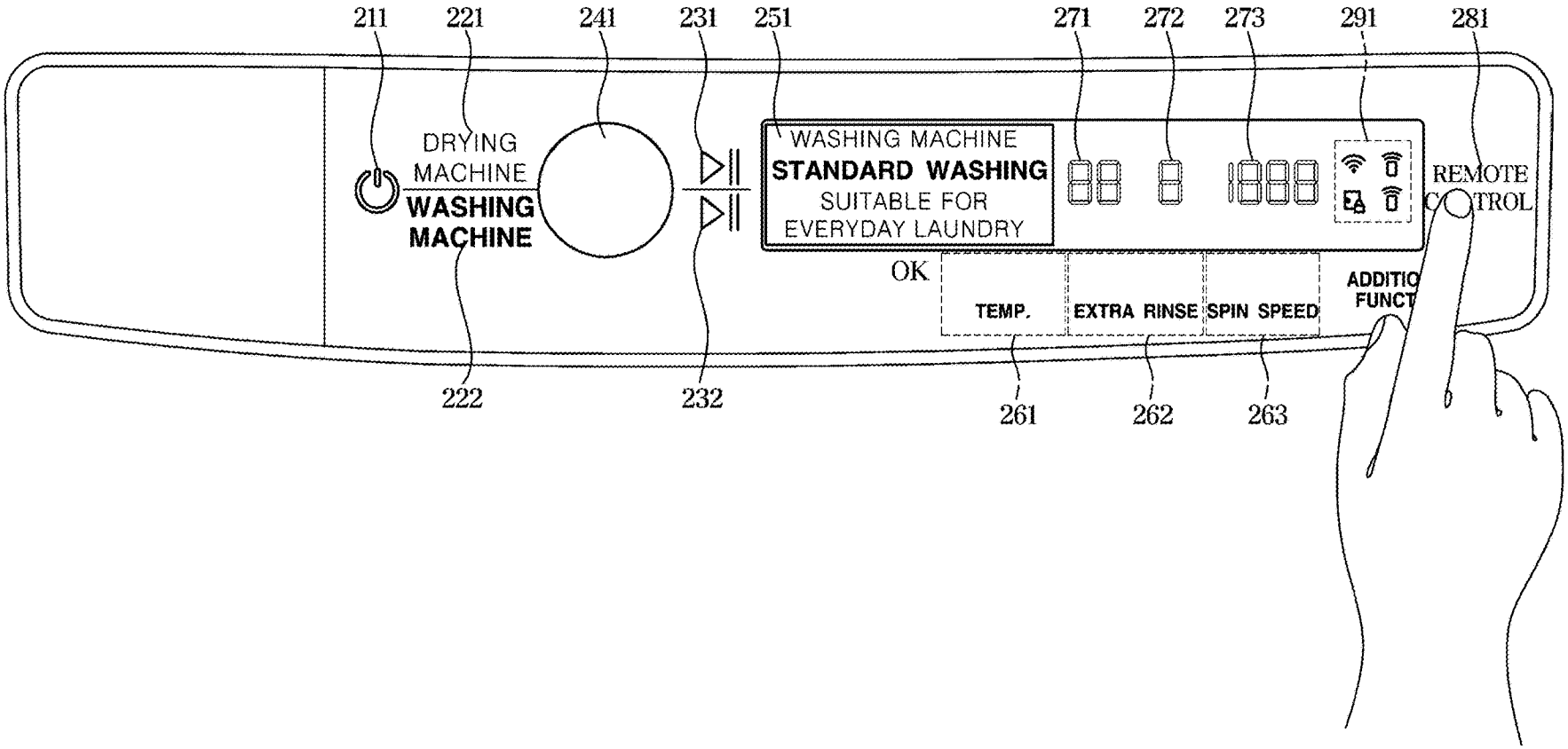
FIG. 23 is a view illustrating remote control activation by a washing machine according to an embodiment.

FIGS. 22*a* and 22*b* illustrate a remote control activation method of a washing machine and a drying machine according to an embodiment. FIG. 23 is a view illustrating remote control activation by a washing machine according to an embodiment.

Referring to FIGS. 22*a*, 22*b*, and 23, a remote control activation method 1300 of the washing machine 100 is described.

The washing machine 100 may be turned on (1305), obtain information of the drying machine 300 from the drying machine 300 (1310), operate in the washer control mode (1315), display the washing setting information or the washing operation information (1320), and determine whether the user input for switching to the dryer control mode is obtained (1325).

Operation 1305, operation 1310, operation 1315, operation 1320, and operation 1325 may be the same as operation 1105, operation 1110, operation 1115, operation 1120, and operation 1125 illustrated in FIG. 16.

When it is determined that the washing machine 100 does not obtain the user input for switching to the dryer control mode (NO in 1325), the washing machine 100 may determine whether the user input for the remote control is obtained in the washer control mode (1330).

The control panel 110 may be provided with the remote control button 281 for activating the remote control of the washing machine 100 and/or the drying machine 300 using the external device (e.g., the user device).

For example, as illustrated in FIG. 23, the user may input the user input for activating the remote control of the washing machine 100 and/or the drying machine 300 through the remote control button 281. In addition, the user may input the user input to deactivate the remote control of the washing machine 100 and/or the drying machine 300 through the remote control button 281 while the remote control of the washing machine 100 and/or the drying machine 300 is activated. Accordingly, the user may activate the drying machine 300 through the remote control button 281 while operation information of the washing machine 100 is displayed on the display 251. Additionally, the user may activate the washing machine 100 through the remote control button 281 while operation information of the drying machine is displayed on the display 251.

The controller 190 may obtain the user input for activating the remote control of the washing machine 100 and/or the drying machine 300 or the user input for deactivating the remote control through the remote control button 281.

When it is determined that the user input for activating the remote control is not obtained (NO in 1330), the washing machine 100 may wait for the user input in the washer control mode.

When it is determined that the user input for activating the remote control is obtained (YES in 1330), the washing machine 100 may determine whether the door 102 of the washing machine 100 is locked (1335).

The controller 190 may determine whether the door of the washing machine 100 is locked based on the operation information of the door lock 104. The controller 190 may control the door lock 104 to lock the door 102 and store data indicating the lock of the door 102 in the memory 192 when the door 102 is closed and the user input for starting washing is obtained.

The controller 190 may identify whether the door 102 of the washing machine 100 is locked based on data stored in the memory 192.

When it is determined that the door 102 of the washing machine 100 is locked (YES in 1335), the washing machine 100 may activate the remote control of the washing machine 100 (1340).

The controller 190 may allow wireless remote control by the external device (e.g., the user device). For example, the controller 190 may wirelessly obtain the control command for the remote control from the external device through the communication device 180, and control the operation of the washing machine 100 in response to the obtained control command.

When it is determined that the door 102 of the washing machine 100 is not locked (NO in 1335), the washing machine 100 may determine whether the door 302 of the drying machine 300 is locked (1345).

The controller 190 may determine whether the door 302 of the drying machine 300 is locked based on the operation information of the door lock 304 of the drying machine 300. The drying machine 300 may control the door lock 304 to lock the door 302 and transmit data indicating the lock of the door 302 to the washing machine 100 through the communication device 380 when the door 302 is closed and the user input for starting drying is obtained.

The controller 190 of the washing machine 100 may identify whether the door 302 of the drying machine 300 is locked, based on data received from the drying machine 300.

When it is determined that the door 302 of the drying machine 300 is locked (YES in 1345), the washing machine 100 may activate the remote control of the drying machine 300 (1350).

The controller 190 may control the communication device 180 to transmit the control command to the drying machine 300 to allow the wireless remote control of the drying machine 300 by the external device (e.g., user device, etc.). In response to receiving the control command to allow the wireless remote control, the controller 390 of the drying machine 300 wirelessly obtains the control command for the remote control from the external device through the communication device 380 and controls the operation of the drying machine 300 in response to the obtained control command.

When it is determined that the door 302 of the drying machine 300 is not locked (NO in 1345), the washing machine 100 may continue to obtain the user input in the washer control mode.

Returning to operation 1325, upon obtaining the user input for switching to the dryer control mode (YES in 1325), the washing machine 100 may obtain information of the drying machine 300 from the drying machine 300 (1355). The washing machine 100 may operate in the dryer control mode (1360), display the drying setting information or the drying operation information (1365), and determine whether the user input for switching to the washer control mode is obtained (1370).

Operation 1355, operation 1360, operation 1365, and operation 1370 may be the same as operation 1155, operation 1160, operation 1165, and operation 1170 illustrated in FIG. 16.

When the user input for switching to the washer control mode is obtained (YES in 1370), the washing machine 100 may operate in the washer control mode (1315).

When it is determined that the washing machine 100 does not obtain the user input for switching to the washer control mode (NO in 1370), the washing machine 100 may determine whether the user input for the remote control is obtained in the dryer control mode (1375).

Operation 1375 may be the same as operation 1330.

When it is determined that the washing machine 100 obtains the user input for activating the remote control (YES in 1375), the washing machine 100 may determine whether the door 302 of the drying machine 300 is locked (1380). When it is determined that the door 302 of the drying machine 300 is locked (YES in 1380), the washing machine 100 may activate the remote control of the drying machine 300 (1385).

Operation 1380 and operation 1385 may be the same as operation 1345 and operation 1350.

When it is determined that the door 302 of the drying machine 300 is not locked (NO in 1380), the washing machine 100 may determine whether the door 102 of the washing machine 100 is locked (1390). When it is determined that the door 102 of the washing machine 100 is locked (YES in 1390), the washing machine 100 may activate the remote control of the washing machine 100 (1395).

Operation 1390 and operation 1395 may be the same as operation 1335 and operation 1340.

When it is determined that the door 102 of the washing machine 100 is not locked (NO in 1390), the washing machine 100 may continue to obtain the user input in the dryer control mode.

As described above, the washing machine 100 may allow the wireless remote control of the washing machine 100 in response to the user input for activating the remote control, and may transmit the control command for allowing the wireless remote control of the drying machine 300 to the drying machine 300. However, when it is determined that the door 102 of the washing machine 100 is not locked, the washing machine 100 may not allow the remote control. When it is determined that the door 302 of the drying machine 300 is not locked, the washing machine 100 may not transmit the control command for allowing the wireless remote control of the drying machine 300 to the drying machine 300.

When the remote control is permitted, the washing machine 100 (or drying machine) may wirelessly communicate with the external device and may receive the control command from the external device. When the washing machine 100 (or drying machine) communicates wirelessly, the washing machine 100 (or drying machine) may be located away from the external device. Therefore, the user of the external device may operate the washing machine 100 (or drying machine) without confirming the state of the washing machine 100 (or drying machine). For example, even if a pet or the like is contained inside the washing machine 100 (or drying machine), the user may operate the washing machine 100 (or drying machine) without confirming the pet. To prevent this, the washing machine 100 (or drying machine) may allow the remote control when the door 102 is locked (i.e., after the operation of the washing machine is started). The remote control of the drying machine 300 may be activated in the same way as the washing machine 100.

Figure 24:
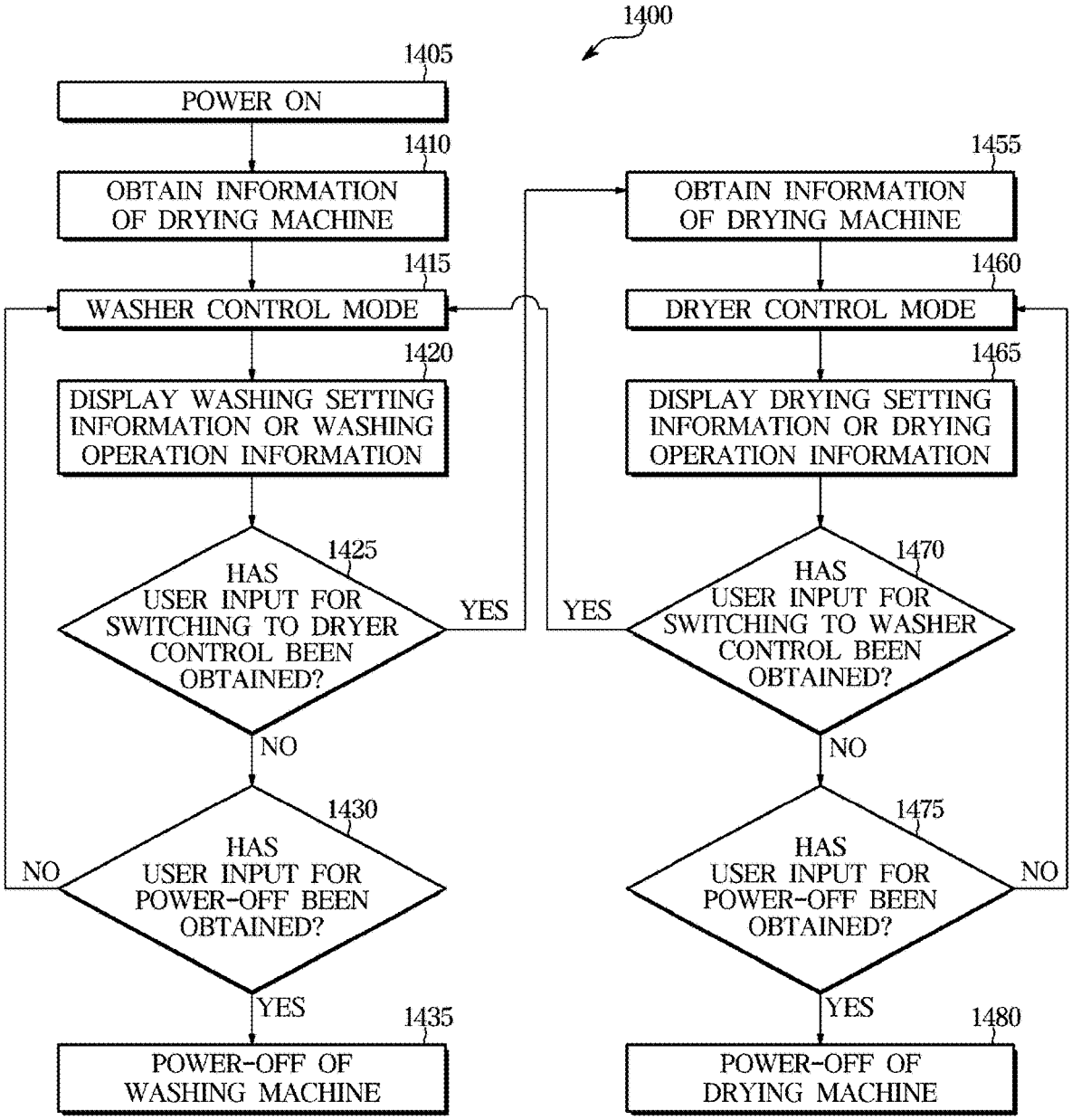
FIG. 24 is a view illustrating a power-off method of a washing machine and a drying machine according to an embodiment.
Figure 25:
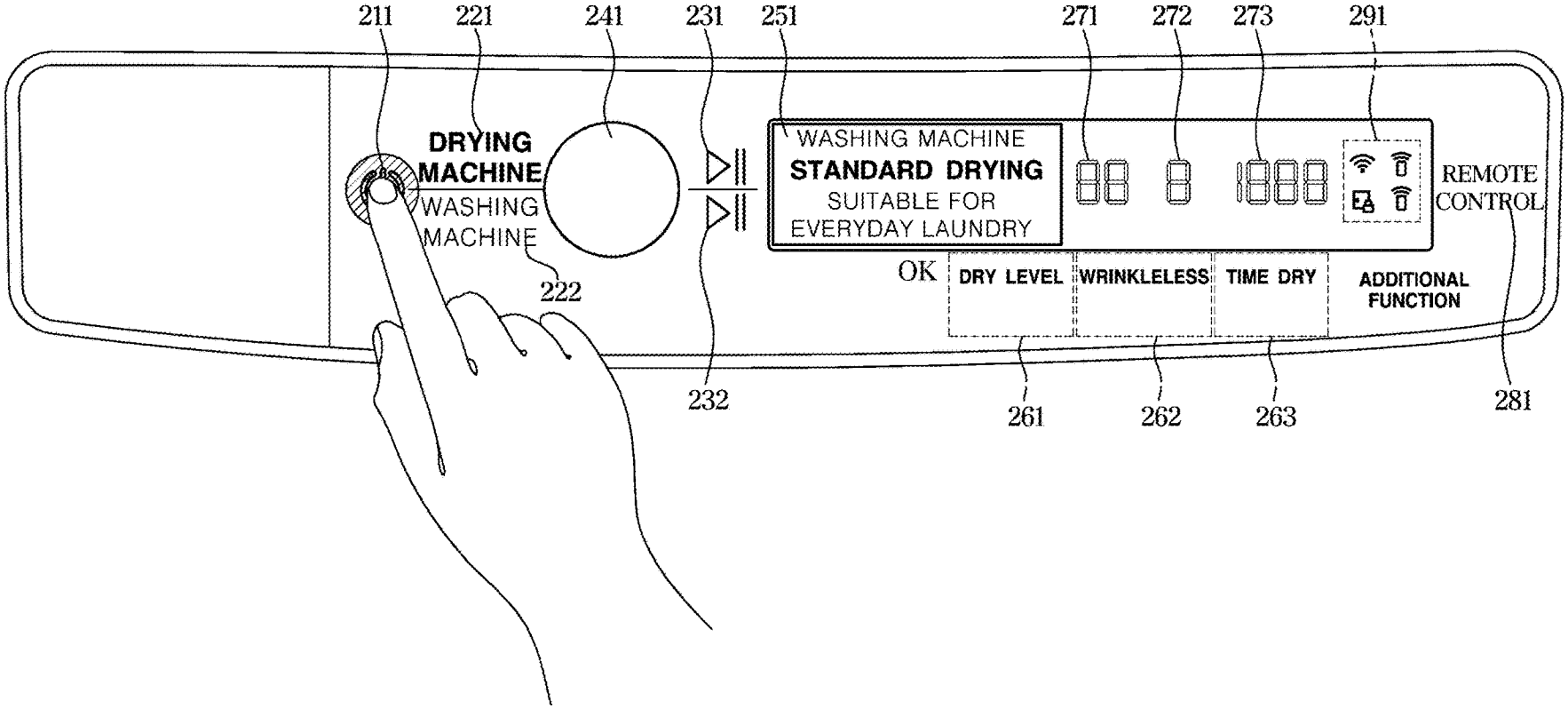
FIG. 25 is a view illustrating power-off of a drying machine by a washing machine according to an embodiment.

FIG. 24 is a view illustrating a power-off method of a washing machine and a drying machine according to an embodiment. FIG. 25 is a view illustrating power-off of a drying machine by a washing machine according to an embodiment.

Referring to FIGS. 24 and 25, a power-off method 1400 of the washing machine 100 is described.

The washing machine 100 may be turned on (1405), obtain information of the drying machine 300 from the drying machine 300 (1410), operate in the washer control mode (1415), display the washing setting information or the washing operation information (1420), and determine whether the user input for switching to the dryer control mode is obtained (1425).

Operation 1405, operation 1410, operation 1415, operation 1420, and operation 1425 may be the same as operation 1105, operation 1110, operation 1115, operation 1120, and operation 1125 illustrated in FIG. 16.

When it is determined that the washing machine 100 does not obtain the user input for switching to the dryer control mode (NO in 1425), the washing machine 100 may determine whether the user input for power-off in the washer control mode (user input for switching to the standby state) is obtained (1430).

The control panel 110 may be provided with the washer power button 211 for obtaining the user input to power-on the washing machine 100 or power-off the washing machine 100.

For example, as illustrated in FIG. 24, the user may input the user input for switching the washing machine 100 in the "on state" to the "standby state" through the washer power button 211 in the washer control mode. In response to the washer power button 211 being touched or pressed, the controller 190 may switch the washing machine 100 from the "standby state" to the "on state" or from the "on state" to the 'standby state.'

When it is determined that the user input for power-off (user input for switching to the standby state) is not obtained (NO in 1430), the washing machine 100 may wait for the user input in the washer control mode.

When it is determined that the user input for power-off is obtained (YES in 1430), the washing machine 100 is powered-off (turns washing machine to the standby state) (1435).

The controller 190 may switch the washing machine 100 in the "on state" to the 'standby state.'

In the 'standby state,' limited power may be supplied to the components of the washing machine 100. For example, the power may be supplied to all of the components of the washing machine 100 in the "on state," but in the 'standby state,' the power may be limitedly supplied to the control panel 110, the communication device 180, and the controller 190.

As such, the controller 190 may switch the washing machine 100 in the "on state" to the "standby state" in response to obtaining the user input for power-off in the washer control mode.

Returning to operation 1425, upon obtaining the user input for switching to the dryer control mode (YES in 1425), the washing machine 100 may obtain information of the drying machine 300 from the drying machine 300 (1455). The washing machine 100 may operate in the dryer control mode (1460), display the drying setting information or the drying operation information (1465), and determine whether the user input for switching to the washer control mode is obtained (1470).

Operation 1455, operation 1460, operation 1465, and operation 1470 may be the same as operation 1155, operation 1160, operation 1165, and operation 1170 illustrated in FIG. 16.

When the user input for switching to the washer control mode is obtained (YES in 1470), the washing machine 100 may operate in the washer control mode (1415).

When it is determined that the washing machine 100 does not obtain the user input for switching to the washer control mode (NO in 1470), the washing machine 100 may determine whether the user input for power-off in the dryer control mode is obtained (1475). When it is determined that the washing machine 100 has obtained the user input for power-off (YES in 1475), the drying machine 300 may be powered-off (turned the washing machine to the standby state) (1480).

In response to the washer power button 211 being touched or pressed in the dryer control mode, the controller 190 may transmit the control command for switching the power state of the drying machine 300 to the drying machine 300 through the communication device 180.

For example, the controller 190 may identify the power state of the drying machine 300 (e.g., in the standby state or in the on state) based on information received from the drying machine 300. Upon identifying that the drying machine 300 is in the 'standby state,' the controller 190 may transmit the control command for switching the drying machine 300 that is in the "standby state" to the "on state" to the drying machine 300. Upon identifying that the drying machine 300 is in the "on state," the controller 190 may transmit the control command for switching the drying machine 300 that is in the "on state" to the "standby state" to the drying machine 300.

The controller 390 of the drying machine 300 may receive the control command for switching the power state from the washing machine 100 and switch the power state of the drying machine 300 in response to the received control command.

In the above, it has been described that the washing machine 100 changes the power state of the drying machine 300 in response to the washer power button 211 being touched or pressed in the dryer control mode, but is not limited thereto. The washing machine 100 may change the power state of the washing machine 100 itself in response to the washer power button 211 being touched or pressed in the dryer control mode. Particularly, the washing machine 100 may be switched from the "on state" to the "standby state" in response to the washer power button 211 being touched or pressed in the dryer control mode.

As described above, the washing machine 100 may switch the power state from the "on state" to the "standby state" in response to the user input for power-off in the washer control mode. The washing machine 100 may transmit the control command for switching the power state of the drying machine 300 to the drying machine 300 in response to the user input for power-off in the dryer control mode. Thereby, the user may power-on or power-off the drying machine 300 using the control panel 110 of the washing machine 100.

As described above, the washing machine may include the control panel; the drum; the drum motor; the communication device configured to exchange data with the drying machine; and the controller electrically connected to the control panel, the drum motor, and the communication device. The controller may operate in one of a first mode and a second mode depending on a first user input through the control panel, control the communication device to transmit the control command for controlling the drying machine to the drying machine in response to a second user input through the control panel in the first mode, and control the drum motor to rotate the drum in response to a third user input through the control panel in the second mode.

Thereby, the user may not only control the operation of the washing machine using the control panel of the washing machine, but also control the operation of the drying machine in communication with the washing machine. In other words, the user may be provided with the first user interface for controlling the washing machine and the second user interface for controlling the drying machine through one control panel.

The control panel may include a first control switch and a second control switch. The controller may switch to the first mode in response to the user input through the first control switch in the second mode, and may switch to the second mode in response to the user input through the second control switch in the first mode.

The control panel may include at least one input switch. The controller may obtain the second user input for controlling the drying machine through the at the least one input switch in the first mode, and may obtain the third user input for controlling the drying machine through the at the least one input switch in the second mode.

Thereby, a size of a menu (or button) for controlling the washing machine or the drying machine is not reduced, and the user's operation error due to miniaturization of the menu (or button) may be prevented or reduced.

The control panel includes a first action switch and a second action switch. In both the first mode and the second mode, the controller may control the communication device to transmit the control command for starting the drying operation to the drying machine in response to the user input through the first action switch, and may control the drum motor to rotate the drum for washing in response to the user input through the second action switch.

Thereby, the user may stop the washing machine or the drying machine with one button in an urgent situation, and may further quickly stop the operation of the drying machine or the washing machine in the urgent situation.

The communication device may exchange data with the drying machine, either by wire or wirelessly. When the communication device exchanges data with the drying machine by wire, the controller may control the communication device to transmit the control command for starting the drying operation of the drying machine. When the communication device exchanges data with the drying machine wirelessly, the controller may not transmit the control command for starting the drying operation of the drying machine.

Thereby, the user of the washing machine may be prevented from operating the drying machine without checking the drying machine. In other words, a safety accident caused by the drying machine may be prevented or reduced.

The control panel may include at least one input switch. In both the first mode and the second mode, the controller may control the communication device to transmit the control command for activating the remote control of the drying machine in response to the user input through the at least one input switch, and may activate the remote control of the washing machine. The washing machine may further include a cabinet that accommodates the drum and has an opening formed on a front surface and a door that can close the opening. The controller may determine whether the door is closed in response to the user input through the at least one input switch, activate the remote control of the washing machine in response to determining that the door is closed, and deactivate the remote control of the washing machine in response to determining that the door is not closed.

Thereby, the user of the external device may be prevented from operating the washing machine (or drying machine) without checking the condition of the washing machine (or drying machine). In other words, a safety accident of the washing machine (or drying machine) by remote control may be prevented or reduced.

In response to at least one of the user input for power-on of the washing machine and the user input for controlling the drying machine, the controller may control the communication device to identify when it is communicable with the drying machine and to receive information from the drying machine. The controller may control the communication device to identify whether it is possible to communicate with the drying machine and receive information from the drying machine at predetermined times.

Thereby, the washing machine may monitor the operation of the drying machine, and provide information about the operation of the drying machine to the user through the control panel.

According to an aspect of the disclosure, there is provided the washing machine capable of controlling the drying machine using the control panel of the washing machine, and the method of controlling the washing machine. Thereby, even if the drying machine is installed on the washing machine, the user may operate the drying machine without inconvenience.

According to another aspect of an embodiment, there is provided the washing machine capable of integrating the menu (or button) capable of controlling the washing machine and the menu (or button) capable of controlling the drying machine, and the method of controlling the washing machine. Thereby, a size of the menu (or button) for controlling the washing machine or the drying machine is not reduced, and the user's operation error due to miniaturization of the menu (or button) may be prevented or reduced.

According to another aspect of an embodiment, there is provided the washing machine in which the menu (or button) for starting an operation of the washing machine or temporarily stopping the operation is provided separately from the menu (or button) for starting an operation of the drying machine or temporarily stopping the operation, and the method of controlling the washing machine. Thereby, the user may stop the washing machine or the drying machine with one button in an urgent situation.

Exemplary embodiments of the present disclosure have been described above. In the exemplary embodiments described above, some components may be implemented as a "module". Here, the term 'module' means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

With that being said, and in addition to the above described exemplary embodiments, embodiments can thus be implemented through computer readable code/instructions in/on a medium, e.g., a computer readable medium, to control at least one processing element to implement any above described exemplary embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

While exemplary embodiments have been described with respect to a limited number of embodiments, those skilled in the art, having the benefit of this disclosure, will appreciate that other embodiments can be devised which do not depart from the scope as disclosed herein. Accordingly, the scope should be limited only by the attached claims.

Although the present disclosure has been described with various embodiments, various changes and modifications may be suggested to one skilled in the art. It is intended that the present disclosure encompass such changes and modifications as fall within the scope of the appended claims.

What is claimed is:

1. An apparatus comprising:

a washing machine having a first cabinet with a first access opening at a front side of the first cabinet;

a drying machine disposed on the washing machine, the drying machine being capable of communicating with the washing machine and having a second cabinet with a second access opening at a front side of the second cabinet;

a control panel disposed between the first access opening and the second access opening, the control panel including:

a first selecting button configured to receive an input for selecting the washing machine, a first start/pause button configured to receive an input for starting or pausing an operation of the washing machine, a plurality of setting buttons configured to receive inputs for modifying the operation of the apparatus, a first set of light emitting elements disposed behind the plurality of setting buttons to indicate settings for modifying the operation of the washing machine, a second set of light emitting elements disposed behind the plurality of setting buttons to indicate settings for modifying the operation of the drying machine, wherein the second set of light emitting elements are different from the first set of light emitting elements, a second selecting button configured to receive an input for selecting the drying machine, a second start/pause button configured to receive an input for starting or pausing an operation of the drying machine, and at least one display configured to display operation information of the washing machine and operation information of the drying machine; and at least one controller configured to:

control the first set of light emitting elements to indicate a state that the plurality of setting buttons are enabled to receive the inputs for modifying the operation of the washing machine in response to the input received through the first selecting button; and cause the drying machine to pause the operation of the drying machine in response to the input received through the second start/pause button while the first set of light emitting elements indicates the state that the plurality of setting buttons are enabled to receive the inputs for modifying the operation of the washing machine.

2. The apparatus according to claim 1, wherein the at least one display is configured to display a first time remaining until an end of a washing operation and a second time remaining until an end of an operation of the drying machine together.

3. The apparatus according to claim 1, wherein:

the first start/pause button is disposed under the second start/pause button on the control panel, the first selecting button is disposed under the second selecting button on the control panel, the control panel further includes:

a first light emitting element disposed behind the first start/pause button; and a second light emitting element disposed behind the second start/pause button, and the at least one controller is configured to:

control the first light emitting element in response to the input received through the first selecting button; and control the second light emitting element in response to the input received through the second selecting button.

4. The apparatus according to claim 1, wherein:

the control panel further includes a remote control activating button configured to receive an input for activating remote control of the drying machine, and the at least one controller is further configured to cause the drying machine to activate the remote control of the drying machine based on an input received through the remote control activating button while the first set of light emitting elements indicates the state that the plurality of setting buttons are enabled to receive the inputs for modifying the operation of the washing machine.

5. The apparatus according to claim 4, wherein:

the apparatus further comprises a door for closing the second access opening, and the at least one controller is further configured to output a control signal to the drying machine for activating the remote control of the drying machine based on the door being locked.

6. The apparatus according to claim 1, wherein:

the at least one display comprises a setting display configured to indicate the modified operation of the washing machine; and the at least one controller is configured to control the setting display to indicate the modified operation in response to the input received through each of the plurality of setting buttons.

7. The apparatus according to claim 6, wherein the modified operation of the washing machine comprises a temperature for the operation of the washing machine.

8. An apparatus comprising:

a washing machine having a first cabinet with a first access opening at a front side of the first cabinet;

a drying machine disposed on the washing machine, the drying machine being capable of communicating washing machine and having a second cabinet with a second access opening at a front side of the second cabinet;

a control panel disposed between the first access opening and the second access opening, the control panel including:

a first selecting button configured to receive an input for selecting the washing machine, a first start/pause button configured to receive an input for starting or pausing an operation of the washing machine, a second selecting button configured to receive an input for selecting the drying machine, a second start/pause button configured to receive an input for starting or pausing an operation of the drying machine, a plurality of setting buttons configured to receive inputs for modifying the operation of the apparatus, a first set of light emitting elements disposed behind the plurality of setting buttons to indicate settings for modifying the operation of the washing machine, a second set of light emitting elements disposed behind the plurality of setting buttons to indicate settings for modifying the operation of the drying machine, wherein the second set of light emitting elements are different from the first set of light emitting elements and at least one display configured to display operation information of the washing machine and operation information of the drying machine; and at least one controller configured to:

control the second set of light emitting elements to indicate a state that the plurality of setting buttons are enabled to receive the inputs for modifying the operation of the drying machine in response to the input received through the second selecting button; and cause the washing machine to pause the operation of the washing machine in response to the input received through the first start/pause button while the second set of light emitting elements indicates the state that the plurality of setting buttons are enabled to receive the inputs for modifying the operation of the drying machine, and wherein the at least one display comprises a setting display configured to indicate the modified operation of the drying machine, and wherein the at least one controller is further configured to control the setting display to indicate the modified operation in response to the input received through each of the plurality of setting buttons.

9. The apparatus according to claim 8, wherein the at least one display is configured to display a first time remaining until an end of a washing operation and a second time remaining until an end of an operation of the drying machine together.

10. The apparatus according to claim 8, wherein:

the first start/pause button is disposed under the second start/pause button on the control panel, and the first selecting button is disposed under the second selecting button on the control panel, the control panel further includes:

a first light emitting element disposed behind the first start/pause button; and a second light emitting element disposed behind the second start/pause button, and the at least one controller is configured to:

control the first light emitting element in response to the input received through the first selecting button; and control the second light emitting element in response to the input received through the second selecting button.

11. The apparatus according to claim 8, wherein:

the control panel further includes a remote control activating button configured to receive an input for activating remote control of the washing machine, and the at least one controller is further configured to activate the remote control of the washing machine in response to an input received through the remote control activating button while the second set of light emitting elements indicates the state that the plurality of setting buttons are enabled to receive the inputs for modifying the operation of the drying machine.

12. The apparatus according to claim 11, further comprising a door for closing the first access opening, wherein the at least one controller is further configured to activate the remote control of the washing machine based on the door being locked.

13. The apparatus according to claim 8, wherein the modified operation of the drying machine comprises a dry level for the operation of the drying machine.

* * * * *